US009323224B2

(12) United States Patent
Nguyen

(10) Patent No.: US 9,323,224 B2
(45) Date of Patent: Apr. 26, 2016

(54) WALL CLOCK WITH PERPETUAL CALENDAR MECHANISM

(71) Applicant: Thanh Van Nguyen, Sacramento, CA (US)

(72) Inventor: Thanh Van Nguyen, Sacramento, CA (US)

( * ) Notice: Subject to any disclaimer, the term of this patent is extended or adjusted under 35 U.S.C. 154(b) by 0 days.

(21) Appl. No.: 13/911,887

(22) Filed: Jun. 6, 2013

(65) Prior Publication Data

US 2013/0329531 A1 Dec. 12, 2013

Related U.S. Application Data

(60) Provisional application No. 61/689,452, filed on Jun. 6, 2012.

(51) Int. Cl.
*G04B 19/20* (2006.01)

(52) U.S. Cl.
CPC ..... *G04B 19/202* (2013.01)

(58) Field of Classification Search
CPC ..... G04B 19/20
USPC ..... 368/28, 35, 37
See application file for complete search history.

(56) References Cited

U.S. PATENT DOCUMENTS

| | | | | | |
|---|---|---|---|---|---|
| D297,621 | S | * | 9/1988 | Teves | D10/4 |
| 4,972,393 | A | * | 11/1990 | Sase et al. | 368/28 |
| 5,184,333 | A | * | 2/1993 | Caspar | 368/28 |
| 5,274,616 | A | * | 12/1993 | Shu | 368/39 |
| D348,617 | S | * | 7/1994 | Riley | D10/57 |
| 5,724,317 | A | * | 3/1998 | Kubota et al. | 368/11 |
| D395,830 | S | * | 7/1998 | Riley | D10/4 |
| 6,160,766 | A | * | 12/2000 | Chiang | 368/37 |
| 7,113,450 | B2 | * | 9/2006 | Plancon et al. | 368/10 |
| 7,706,214 | B2 | * | 4/2010 | Scheufele | 368/38 |
| 8,144,547 | B2 | * | 3/2012 | Plancon et al. | 368/10 |
| 8,830,798 | B2 | * | 9/2014 | Schmidt | 368/37 |
| 2009/0003139 | A1 | * | 1/2009 | Kuepfer et al. | 368/35 |

* cited by examiner

*Primary Examiner* — Amy Cohen Johnson
*Assistant Examiner* — Jason Collins

(57) ABSTRACT

Wall clock with a perpetual calendar mechanism comprising an outer case, a quartz movement, a day of the week disc, a tens disc and a units disc, a gear train for driving the discs, another gear train for driving a month indicator hand, a battery set for a clock movement, another battery set for a drive motor, a calendar cam with forty-eight interstices, the depths of the interstices are various, depending on the lengths of months spanning four years, including a leap year, and a three step cam formed on the rear surface of the units disc and a switch control assembly having a control arm which has one end thereof contacts a bottom of the interstice of the calendar cam, where the three step cam initiates an end-of-the-month day-correction mechanism.

22 Claims, 14 Drawing Sheets

28
29
156
151
161
159
158
157
161
162

164
163
165
27
152
154
152
163

153
26
155

28
156
151
159
158
157
29
161

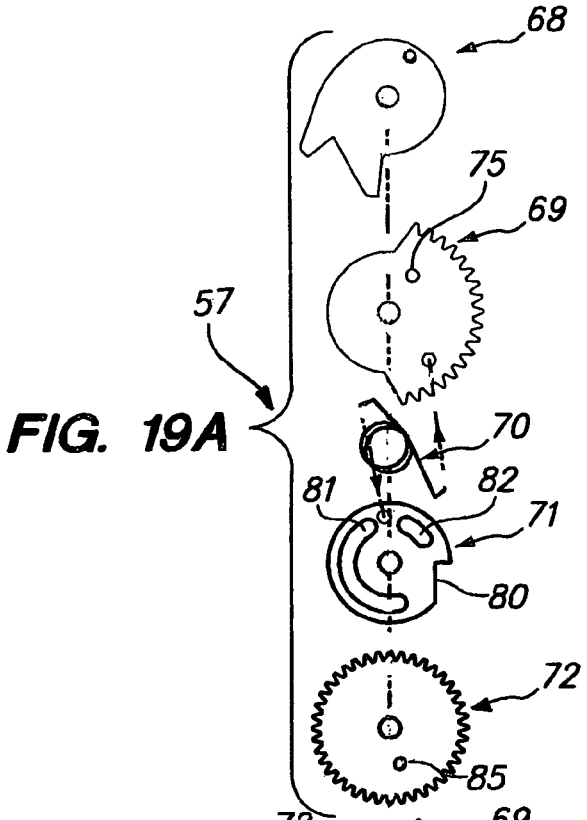
FIG. 19A
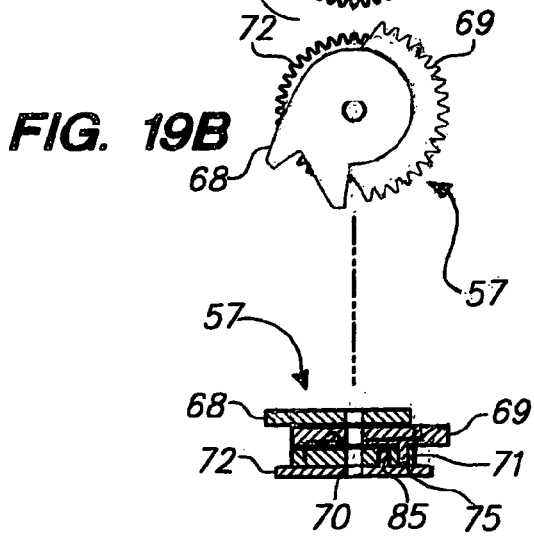
FIG. 19B
FIG. 19C
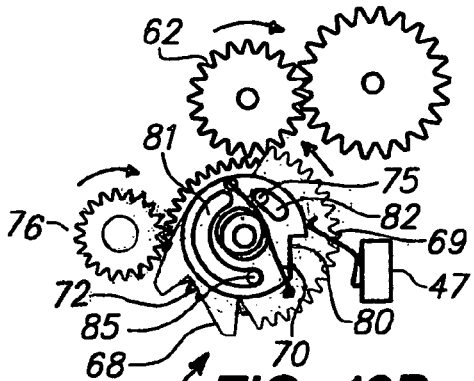
FIG. 19D
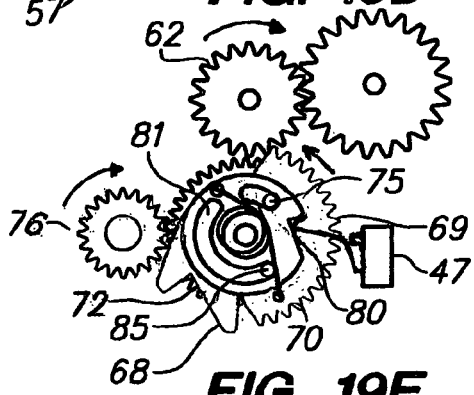
FIG. 19E
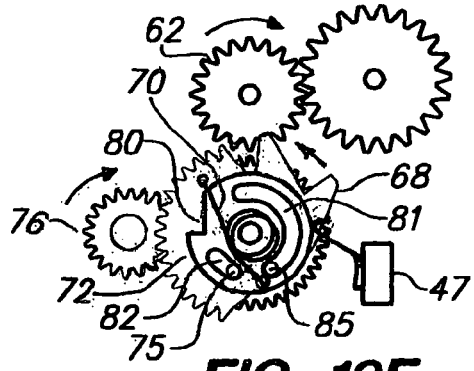
FIG. 19F
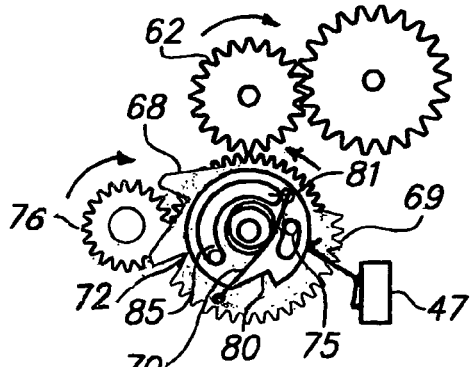
FIG. 19G

WALL CLOCK WITH PERPETUAL CALENDAR MECHANISM

CROSS-REFERENCE TO RELATED APPLICATIONS

This application claims the benefit of U.S. Provisional application Ser. No. 61/689,452 filed on Jun. 6, 2012.

BACKGROUND OF THE INVENTION

1. Field of the Invention

This invention relates to a wall clock with a thermometer and a perpetual calendar mechanism comprising: an outer case; a quartz movement; a temperature device; switches; two battery sets; a drive motor; a day gear train to drive a day of the week disc, a tens disc, and a units disc; a month gear train with a gear wheel and a calendar cam to drive a month indicator hand. Calendar cam has forty-eight teeth and forty-eight interstices, the depths of which depend on the length of months. Calendar cam has a leap year adjustment mechanism. A control switch assembly has a control arm portion that carries a switch and a movable pin. A three-step cam mounted on the rear surface of the units disc cooperates with the movable pin on control arm portion to switch a mechanism on that causes the units disc to correct itself at the end of every month providing an end-of-the-month day-correction mechanism. Wall clock includes a battery replacement or low battery signal flag.

2. Description of the Prior Art

Clocks or timepieces with perpetual calendar mechanisms have been known, in which a clock movement having time indicator hands to indicate time, and an arrangement automatically controls displays of days and dates, including months having 28, 29, 30, or 31 days.

For example, U.S. Pat. No. 3,939,645 granted to Charbonney. A calendar timepiece movement comprising three indicators, the first indicator bears the series of units figures from 0 to 9 twice, the second indicator bears the series of ten figures, from 0 to 33 times and the third indicator displaying the day of the week; a driving mechanism wherein said indicators are coaxial with an hour wheel; a correction mechanism comprising a rotating correction assembly and said driving mechanism comprising a calendar wheel actuating said first indicator; an intermediate rotating part coaxial said calendar wheel, actuated by said first indicator and actuating said second indicator; and a shifting member coaxial with said correction assembly for shifting said third indicator.

For another example, U.S. Pat. No. 7,609,589 granted to Shue. A perpetual calendar clock comprising an analog clock and three sets of rotary wheels. The rotary wheels correspond to displays of the months, the day of the month and the day of the week. A clock 4 provides three output terminals for controlling the actuations of three motors through the use of rotatable contact wheels.

Other attempts have been made over the years to have clocks or timepieces with perpetual calendar mechanisms. Thus, in addition to those recited above, applicant is familiar with the following U.S. Patents:

U.S. Pat. No. 4,059,953 Nov. 29, 1977 Morriision
U.S. Pat. No. 5,432,759 Jul. 11, 1995 Vaucher
U.S. Pat. No. 5,699,321 Dec. 16, 1997 Vaucher
U.S. Pat. No. 6,081,483 Jun. 27, 2000 Capt, et al
U.S. Pat. No. 6,108,278 Aug. 22, 2000 Rochat
U.S. Pat. No. 6,154,421 Nov. 28, 2000 Solomon
U.S. Pat. No. 6,574,167 Jun. 3, 2003 Weissbach
U.S. Pat. No. 6,826,122 Nov. 30, 2004 Zaugg U.S. Pat. No. 7,266,050 Sep. 4, 2007 Eisenegger
U.S. Pat. No. 7,532,546 May 12, 2009 Sizuki
US-D101,723 Oct. 27, 1936 O. G. William
US-D297,621 Sep. 13, 1988 Teves
US-D348,617 Jul. 12, 1994 Riley
US-D395,830 Jul. 7, 1998 Riley None of the patents referenced, provides a clock which has a clear and large display of time and calendar information and which requires no maintenance, adjustment, or correction in its displayed information, over a four year period.

It is one object of this invention to provide a large dimension of the day and date displays.

It is another object of this invention to provide a complete analog mechanism that displays and corrects the date at the end of every month, accounting for leap years.

It is a specific object of this invention to provide a temperature device with an indicator hand and a large temperature-figure-scale that is easy to see the temperature.

It is further object of this invention to provide an easy reading of time, day, date, and month.

It is yet another object of the invention to provide a four year battery supply to yield a perpetual calendar clock that never needs to be re-set provided batteries are replaced at least every four years.

It is still another object of this invention to provide a low battery signal device that pre-cautions to replace the batteries.

It is further another object of this invention to provide a reliable, and durable perpetual calendar mechanism.

Other objects of this invention will in part be obvious and will in part appear hereinafter.

The invention accordingly comprises an outer case that is a rigid cylindrical-shaped member having a closed end and an open end, a circular intermediate wall and a circular inner wall, the walls, which are mounted upon the inner surface of the closed end, are concentric with a center axis of the outer case, a flange and a ring are mounted to the open end of the outer case.

A day disc has a center hole and a gear ring mounted to the inner circumference of the day disc. The day disc is rotatably disposed above the circular inner wall, so that the outer circumference of the ring forms a slip fit with the inner circumference of the circular inner wall. The day disc has a visual depiction of the seven days of the week, such as MO, TU, WE, TH, FR, SA, SU, equally spaced around on the front surface thereof, and a spacer bump exists between the two names of the days of the week.

A tens disc has a center hole, a visual depiction of three sets of the number sequence 0, 1, 2, 3, equally spaced around on the front surface thereof, and a spacer bump exists between the two numbers. The rear surface of the tens disc has a ring [152] and first catches, second catches and cams thereon. The tens disc is rotatably disposed above the circular intermediate wall, so that the inner circumference of the ring [152] forms a slip fit with the outer circumference of the circular intermediate wall, the center hole of the tens disc sized to accommodate and surround the day disc, and the outer circumference of the ring [152] formed notches to cooperate with a jumper to keep the tens disc in its position.

A units disc has a center hole, a visual depiction of the number sequence 0, 1, 1, 2, 3, 4, 5, 6, 7, 8, 9, equally spaced around on the front surface thereof, a spacer bump exists between the two numbers. The rear surface of the units disc comprises a gear ring [151] engaged with a day gear train for driving the units disc, a first, second and third movable pins cooperate with the first, second catches and the cams on the tens disc to control rotations of the tens disc and the units disc. The units disc is rotatably disposed above the ring [35], so that the outer circumference of the units disc forms a slip fit with the inner circumference of the outer case, and the center hole of the units disc sized to accommodate and surround the tens disc, a notch made into the outer circumference of the units disc between the two numbers to cooperate with a second switch [48] to control the rotation of the units disc.

A clock dial has a day-date-window, a time, month and temperature scale depictions on its front surface. The clock dial is disposed above the flange [34], so that the spacer bumps on the day, tens, and units discs arranged to rotatably engage with the rear surface of the clock dial. A clock cover disc made of glass or clear plastic is disposed above a retainer ring on the clock dial, a cover ring secures the clock cover disc.

A quartz clock movement mounted inside the circular inner wall has a second, minute and hour shafts that pass there through a hole in the center of the clock dial and connected to a second hand, minute hand, and an hour hand. A wheel holding disc is disposed above the clock movement to secure the clock movement.

A temperature device has one end mounted to an axle, and the other end inserted through a hole in a holding portion, the axle passes there through another hole in the holding portion and through a hole in the clock dial and connected with one end of a temperature indicator hand to indicate the temperature.

A first drive assembly has a 24-hour gear wheel, a control switch wheel, a spring, a driven wheel and a two tooth wheel, all of them are coaxially, rotatably disposed to an axle mounted upon the wheel holding disc, so that the 24-hour gear wheel engaging with a 12-hour gear wheel mounted on the hour shaft of the clock movement, the control switch wheel engaging with the terminal of a first switch [47], and the spring connects the control switch wheel to the driven wheel together, a short catch on the 24-hour gear wheel is placed in a first long curved aperture in the control switch wheel to drive the control switch wheel.

Thus, at midnight, the first tooth of the driven wheel that has teeth on about the haft of the outer circumference thereof, engages with a day gear train, and the two-tooth wheel engages with the gear ring [153] on the day disc, at the time, the terminal of the first switch [47] enters a notch in the outer circumference of the control switch wheel, actuating the switch [47] to turn ON, a drive motor starts to drive the day gear train, and the day disc and the units disc to rotate. When the units disc rotates over the terminal of the second switch [48] that causes the switch [48] to turn ON, at the time, the terminal of the switch [47] slides in the notch on the control switch wheel causing the switch [47] to turn OFF. The day disc and the units disc continuously rotate until the last tooth of the two-tooth wheel releases the gear ring on the day disc, then the last tooth of the driven wheel releases the day gear train. The units disc continuously rotates until the terminal of the second switch [48] enters into the notch on the units disc, the switch [48] is turned OFF. A day and date change is done.

As known there are two number 1's on the units disc, the number 1 next to 0 called the first number 1, and the number 1 next to 2 called the second number 1. Whenever number 1 or 2 on the tens disc and the number 1 on the units disc display at the same time within the day-date window (corresponding to days $11^{th}$ or $21^{st}$), the second number 1 will be passed before the next date displayed. More details will be explained below.

The clock of this invention further comprises a calendar cam with a center hole, forty-eight teeth and forty-eight interstices formed in the outer circumference thereof. The depths of the interstices are various depending on the lengths of the months of four years including a leap year. The calendar cam is rotatably disposed above the inner surface of the closed end of the outer case, so that the inner circumference of the calendar cam forms a slip fit with the outer circumference of the circular inner wall, a ring is rotatably secured above the calendar cam and a cam cover disc with a center hole disposed above the ring. The cam cover disc is secured to posts mounted on the inner surface of the closed end of the outer case.

A cam drive assembly comprises a cam driver and a control drive portion, that cooperates with a cam on a control disc to drive the calendar cam one tooth each month. A control switch assembly has a control arm portion. One end of the control arm portion engages with the bottom of the interstice of the calendar cam, the remaining end is engaged with the cam on the control disc to drive the control arm portion. The control arm portion bears a fourth switch [50] and a movable pin that cooperates with a three-step cam on the units disc to control the rotation of the units disc to correct the end-of-the-month correction. More details and other objects will be explained hereinafter.

SUMMARY OF THE INVENTION

Wall clock with a perpetual calendar mechanism includes: an outer case, a clock dial having a day-date window, a day disc, onto which are affixed names of the day, such as MO, TU, WE, TH, FR, SA, SU, and the inner periphery of the day disc has a gear wheel which engages with a day gear train for driving day disc, a tens disc, onto which are affixed three consecutive sets of numbers: 0, 1, 2, and 3 and the rear surface of the tens disc has catches, cams, and a ring with notches formed therein, a units disc, onto which are affixed eleven numbers: 0, 1, 1, 2, 3, 4, 5, 6, 7, 8, 9 and a notch made into the outer side of the units disc between two numbers, the rear surface of the units disc including a gear wheel that engages the day gear train to rotate the units disc and a three step cam, a first, second, and third movable pins. The first and second movable pins respectively cooperate with the catches on the tens disc to drive the tens disc; and the third movable pin cooperates with the cams on the tens disc to control the units disc's rotation.

A 24-hour gear wheel, which is engaged with a 12-hour gear wheel of the quartz clock movement, has a short catch thereon; a control switch wheel has a long curved aperture, called the first aperture, and another long curved aperture, called the second aperture therein, and a notch made into the outer side of the control switch wheel. The control switch wheel is coaxially and rotatably disposed above the 24-hour gear wheel, so that the short catch of the 24-hour gear wheel appears in the first aperture. Another gear wheel called the driven wheel has teeth occupying about half of the wheel on the outer side thereof, and a short catch thereon. The driven wheel is coaxially and rotatably disposed above the control switch wheel, so as the short catch of the driven wheel appears into the second aperture. A spring is coaxially disposed between the driven wheel and the control switch wheel to connect these wheels together. A two-tooth wheel is coaxially disposed above the driven wheel and secured to this wheel, for driving the day disc. A lock ring is fixed to the top of an axle mounted to the holding disc. A switch called the first switch is mounted on the holding disc, engaging with the control switch wheel. Whenever the lever of the first switch enters into the notch on the control switch wheel, the first switch is turned ON.

Another switch called the second switch is mounted to the inner side of the outer case. The lever of the second switch is extended and formed a round end. The round end is entered into a notch on the units disc. Whenever the units disc rotates, the round end allows the units disc to rotate over and pressing down on the round end of the lever, causing the second switch to turn ON, and whenever the round end of the lever enters into the notch on the units disc, the second switch is turned OFF.

The first long curved aperture, which has a short catch of the 24-hour gear wheel therein, allows the control switch wheel to rotate, at the time, the control switch wheel is driven by the driven wheel, during the 24-hour gear rotation. The second long curved aperture, with the short catch of the driven wheel therein, allows the 24-hour gear wheel to rotate when the driven wheel stops rotating. The short catch of the driven wheel appears in the second aperture to keep the control switch wheel rotating, at the time, the control switch wheel is driven by the driven wheel, since the spring does not have enough energy to support to keep the control switch wheel to rotate to jump down the lever of the first switch.

Normally, the spring keeps the driven wheel rotating, as the control switch wheel is driven by the 24-hour gear wheel. And when the 24-hour gear wheel drives the control switch wheel some more, the driven wheel is stopped, since the first tooth of the driven wheel has engaged the day gear train, to allow the spring to force the driven wheel gearing with the gear train as the gear train starts to drive the day disc.

At per midnight, the lever of the first switch jumps into the notch on the control switch wheel, turning the first switch ON, causing the drive motor to start to drive the day gear train. A gear wheel of the day gear train has a top gear wheel engaged to the gear ring on the units disc that drives the units disc. While the units disc is rotating, this cause the second switch to turn ON, prior to the first switch is OFF. While the driven wheel is driven by the day gear train, causing the control switch wheel to rotate, and the lever of the first switch slides in the notch of the control switch wheel, then coming up on the outer side of the control switch wheel, causes the first switch to turn OFF. The day gear train continuously drives the day disc until the last tooth of the two-tooth wheel has released the gear ring on the day disc. The current day has completely appeared through the date window. A jumper, which is controlled by a spring, jumps into the interstice of the ring on the day disc to keep the day disc in the correct position thereof. The units disc continuously rotates until the current day of the month completely appears through the date window and the second switch is turned OFF, as the round end of the lever of the switch enters into the notch on the units disc.

As indicated above, there are two number 1's on the units disc. The number 1 next to 0 is called the first number 1, and the other number 1, remote from the number 0 is called the second number 1. Whenever the number 1 or 2 on the tens disc, and the first number 1 on the units disc appear through the date window at the same time (corresponding to days 11 and 21), the second number 1 on the units disc will rotate past the date window. While the units disc is rotating, one end of the third pin on the units disc slides over the outer side of the cam on the tens disc, causing the other end of the pin actuating a switch called the third switch to turn ON, allowing the units disc continuously to rotate to pass the second number 1. The third movable pin is free moving within the limit thereof. To avoid the third pin unexpectedly contacts the third switch, a bump is mounted to inner side of the outer case and located before the third switch, so as, the end of the third pin always passes the bump, before the other end of the pin slides over the outer side of the cam on the tens disc. Whenever the number 0, 1, or 2 on the tens disc and the number 9 on the units disc appear through the date window at the same time (corresponding to days 09, 19, 29), the tens disc will be driven. While the units disc is rotating, one end of the first movable pin on the units disc slides over the side of a long cam which is attached to the inner side of the ring mounted inner side of the outer case, causing the other end of the pin engages with the catch on the tens disc, and drives the tens disc to the next unit. The first movable pin is released after the pin has passed the long cam, before the units disc stops rotating. A jumper, which controlled by a spring, jumps into the notch on the tens disc to keep the tens disc in the correct position thereof.

Whenever the number 3 on the tens disc and first number 1 on the units disc appear through the date window at the same time (corresponding to day $31^{st}$), the tens disc will be driven. While the units disc is rotating, one end of the second movable pin on the units disc slides over the side of the long cam, causing the other end of the pin to engage with the catch on the tens disc, and drives the tens disc to the next unit. The second pin is released after the pin has passed the long cam.

A calendar cam is formed of forty-eight teeth and forty-eight interstices on the outer periphery of the cam. The depths of the interstices are various, each corresponding to the respective number of days within each month over a period of four years, including a leap year. The shortest depths of the interstices are called the first depths for controlling the corrections of the ends of the months having 28 days; the next deeper interstice is called the second depth for controlling the month having 29 days; the next deeper interstices, called the third depths for controlling the months having 30 days, and the deepest interstices are called fourth depths for controlling the months having 31 days.

The calendar cam is rotatably disposed above the bottom of the outer case; an inner side of the cam is rotatably fitted to the outer side of the circular inner wall mounted to the bottom of the outer case; a ring is disposed above the inner side of the cam; a cover disc is disposed above the ring, so as the top side of the ring rotatably engages with the rear side of a cover disc to keep the calendar cam is rotatable in the position thereof. The cover disc is secured to long nuts mounted to the bottom of the outer case.

A cam drive assembly has a control drive portion. One end of the control drive portion is rotatably mounted to a post mounted to the bottom of the outer case by a two-step bolt. This end of the control drive portion is extended and forms a finger. The finger cooperates with a long cam mounted on the underside of a control disc to rotate the control drive portion to move a cam driver for rotating the calendar cam.

Between the control drive portion and the cam driver are a connector arm and a bell crank. The bell crank is rotatably mounted to a post mounted to the bottom of the outer case, with a spring thereon. This spring helps the bell crank to return to its original position, after completing a cam drive operation. The connector arm has one end rotatably connected to the remaining end of the control drive portion by a rivet. The other end of the connector arm is rotatably connected to one end of the bell crank by another rivet. The cam driver has one end that is rotatably connected to the remaining end of the bell crank by another rivet. A small spring is connected to both of the cam driver and the bell crank together, to force the other end of the cam driver to engage the teeth of the calendar cam.

A control switch assembly has a control arm portion carrying a switch called the fourth switch and a movable pin thereon. The control arm portion includes a pair of brackets to support the movable pin. The movable pin includes a round collar which is movably mounted to engage the fourth switch, and between the pair of brackets, so as whenever the pin slides, it causes the fourth switch to switch ON or OFF. A small wheel, which is mounted to top of the movable pin, cooperates with the three-step cam on the units disc to control the fourth switch. The small wheel also keeps a coil spring in place. Coil spring helps the movable pin return to its original position after the three-step cam has passed the small wheel on the movable pin.

The control arm portion having one end is coaxially, rotatably and respectively mounted above the end of the control drive portion. A two-step screw is inserted through a hole on the end of the control arm portion and driven into a threaded hole on the top end of the two-step bolt to rotatably secure the control arm portion and the two-step bolt together.

The end of the control arm portion is extended to form of a finger. The finger engages to the long cam mounted underside of the control disc at the end of each month to rotate the control arm portion, lifting the other end of the control arm portion out of the interstice of the calendar cam, allowing the cam is rotated by the cam driver. A spring is connected to the control arm portion, to keep the end of the control arm portion to move back and engages with the next bottom of the interstice. The control disc is driven by the day gear train and makes one revolution each month.

The units disc makes three revolutions each month, so the three-step cam passes the small wheel of the pin on the control arm portion three times each month. To avoid a wrong date display, a switch called the fifth switch is arranged to cooperate with the long cam on the control disc to actuate the fifth switch ON, to connect an electrical circuit line. The electrical circuit line is connected from the fourth switch to the fifth switch and then to the drive motor. Normally, the fifth switch is OFF and the electrical circuit line is disconnected. The fifth switch is ON only the last four days of per month, when the long cam on the control disc is pressing on the lever of the fifth switch, and the electrical circuit line is connected, allowing the units disc to continuously rotate to correct the last day of the month, as the fourth switch is ON.

Corrections to the date at the end of the month are as follows. If the current month has 31 days: no correction in the day of the month displayed will be done. Since, the end of the control portion is engaged with the bottom of the interstice of the calendar cam for the month having 31 days. This means, the end of the control portion engages to the bottom of the deepest interstice of the cam, so the three-step cam on the units disc will freely passes the small wheel on the top of the movable pin without an actuation on the fourth switch.

If the current month has 30 days: the end of the control arm portion will be engaged with the bottom of the interstice of the calendar cam, for the month having 30 days. This means, the end of the control portion will be raised higher one step. Thus, while the units disc is rotating to pass the $30^{th}$ day of the month, and before the units disc were stopped at the $31^{st}$ day of the month, the first step of the three-step cam on the units disc will impinge upon the small will of the movable pin, causing the fourth switch to turn ON. Since the fifth switch is already in an ON position, the units disc continuously rotates and keeps the second switch ON, then the fourth switch turns OFF, as the three-step cam has passed the small wheel of the pin. The units disc continuously rotates to display the first day of the next month, and the second switch turns OFF.

If the current month has 29 days, the end of the control arm portion will be engaged with the bottom of the interstice of the calendar cam, for the month having 29 days. This means, the control arm portion is raised higher one more step. Thus, while the units disc is rotating to pass the $29^{th}$ day of the month, and before the units disc were stopped at the $30^{th}$ day of the month, the second step of the three-step cam will impinge upon the small wheel of the pin, causing the fourth switch to turn ON, allowing the units disc continuously to rotate to pass the $30^{th}$ and $31^{st}$ days of the month to display the first day of the next month.

If the current month has 28 days, the end of the control arm portion will be higher one more step. This means, the end of the control arm portion will be engaged with the shallowest interstice of the cam. Thus, while the units disc is rotating to pass the $28^{th}$ day of the month, and before the units disc were stopped at the $29^{th}$ day, the third step of the three-step cam will impinge upon the small wheel, causing the fourth switch to turn ON, allowing the units disc to rotate to pass the $29^{th}$, $30^{th}$, and $31^{st}$ days, to display the first day of the next month.

While the units disc is rotating to pass the $31^{st}$ day of the month, and after the three-step cam has passed the small wheel on the movable pin, the long cam on the control disc will engage to force the finger of the control arm portion, to raise the other end of the control arm portion out of the current interstice of the calendar cam, then the long cam engages the finger of the control drive portion to advance the calendar cam. When the cam begins to rotate the first gear wheel of the gear train for driving the month indicator hand, which is engaged with the gear wheel of the calendar cam, starts to rotate, as well. After the calendar cam is advanced one tooth, the month indicator hand is also advanced, indicating the current month. A jumper jumps into the interstice of the calendar cam to keep the cam in correct position. Another jumper jumps into the interstice of the last gear of the month gear train, to keep the month indicator hand in correct position.

After the long cam on the control disc has passed the fingers of the control arm portion and the control drive portion, the end of the control arm portion returns to its normal position, engaging the bottom of the next interstice of the calendar cam corresponding to the next month. The control drive portion also returns to its original position. The clock of this invention is operated by two battery sets that need to be replaced every four year. This is the time for calendar cam to make one complete revolution.

The front surface of the calendar cam includes a pair of brushes mounted thereon. These brushes provide electrical contacts with a first and second pairs of copper lines mounted on the rear surface of cam cover disc. The first pair has one continuous line connected to one terminal of the clock movement and the other line divided into four segments. Each segment is connected to a respective battery. The brush interconnects a respective line with one of the segments to power the quartz clock movement for a year. The contact brush comes into contact with the next segment as the cam rotated. This process continues until four years have passed.

The second pair of the lines has a continuous connection to one terminal of the drive motor and the other is divided into eight segments, each segment is connected to a respective battery. The remaining brush interconnects a respective line with one of the segments to power the drive motor for six months. The process continues as the cam rotates through one revolution, and the batteries are ready to be replaced.

The indicated time may be adjusted by adjusting a stem wheel on the back of the clock.

The indicated day and date may be adjusted by one day, by pushing a wheel connector bar to cause a gear wheel engages to the day gear train, and a gear wheel engages to the gear wheel on the day disc. The connector bar is locked in place by an auto lock, then a switch called the sixth switch is manually turned ON to cause the units disc to rotate. Two seconds later, the sixth switch is manually turned OFF, with the second switch is ON. The second switch is automatically turned OFF, when the day and date completely appear through the date window. The auto lock is then manually released.

In the event that, the day and date indicated on the clock need to be adjusted by more than one day. The wheel connector bar is pushed to cause a gear wheel to engage the day gear train and a gear to engage the wheel of the day disc. The wheel connector bar is locked in place by the auto lock. The sixth switch is manually turned ON, causing the units disc and the day disc to rotate. These discs continuously rotate until the current day has completely appeared through the date window when the wheel connector bar is manually released. The units disc continuously rotates, until the current day of the month begins to appear through the date window when the sixth switch is manually turned OFF. The units disc continuously rotates until the second switch is automatically turned OFF at the point when the current date has appeared through the date window.

If the indicated month and year need adjustment, the control bar is manually pulled outwardly, temporarily to lift the end of the control arm portion out of the interstice of the calendar cam and the control bar is locked in place by an auto lock. Accessing the rear surface of the clock, a sharp tool is inserted through a cam slot, into one of the holes in the calendar cam. The calendar cam is manually driven clockwise, until the current month and year appear through the windows made through the bottom of the outer case, then the auto lock is manually released.

BRIEF DESCRIPTION OF THE DRAWINGS

FIG. 19A is another exploded view of first drive assembly.

FIG. 19B is a top plan view of the first drive assembly.

FIG. 19C is a cross-sectional view of the first drive assembly taken along the center bisection of the first drive assembly.

FIG. 19D is a top plan view of the first drive assembly at a time of about 11:00 PM when the post 75 of the driven wheel 69 engages the front end of curved slot 82 and first tooth of the driven wheel 69 engages the gear wheel 62 of the gear train 56 and stops rotating, while the post 85 of the 24-hour wheel is still engaged with the front end of the slot 81 and continues to drive the control switch wheel 71.

FIG. 19E is a top plan view of the first drive assembly at a time of midnight, when the short post 75 of the driven wheel 69 engages the rear end of curved slot 82, spring 70 is compressed, post 85 still engages the front end of the slot 81, and the lever of the switch 47 has just entered into notch 80 of the control switch disc 71, causing drive motor 46 to start to drive the date gear train, and the two-tooth wheel starts to drive the day disc 26.

FIG. 19F is a top plan view of the first assembly at after midnight, where the post 75 engages with the first end of the slot 82, the last tooth of the driven wheel 69 is released from the gear train 56, the spring 70 is at its original position, the lever of the switch 47 is moved out of the notch 80, the post 85 engages with the rear end of the slot 81.

FIG. 19G is a top plan view of the first drive assembly at about 7:00 PM where the post 85 of the 24-hour gear wheel 72 engages the front end of the aperture 81 and drives the control switch disc 71 and the driven wheel 69, ready for changing the date, day at the next midnight.

FIG. 43 is an enlarged cutaway view depicting the first step of the three step cam on the units disc as it is about to press on the small wheel to turn the fourth switch ON.

FIG. 44 is an enlarged cutaway view depicting the second step of the three step cam on the units disc as it is about to press on the small wheel to turn the fourth switch ON.

FIG. 45 is an enlarged cutaway view depicting the third step of the three step cam on the units disc as it about to press on the small wheel to turn the fourth switch ON.

DETAILED DESCRIPTION OF THE INVENTION

Figure 1:
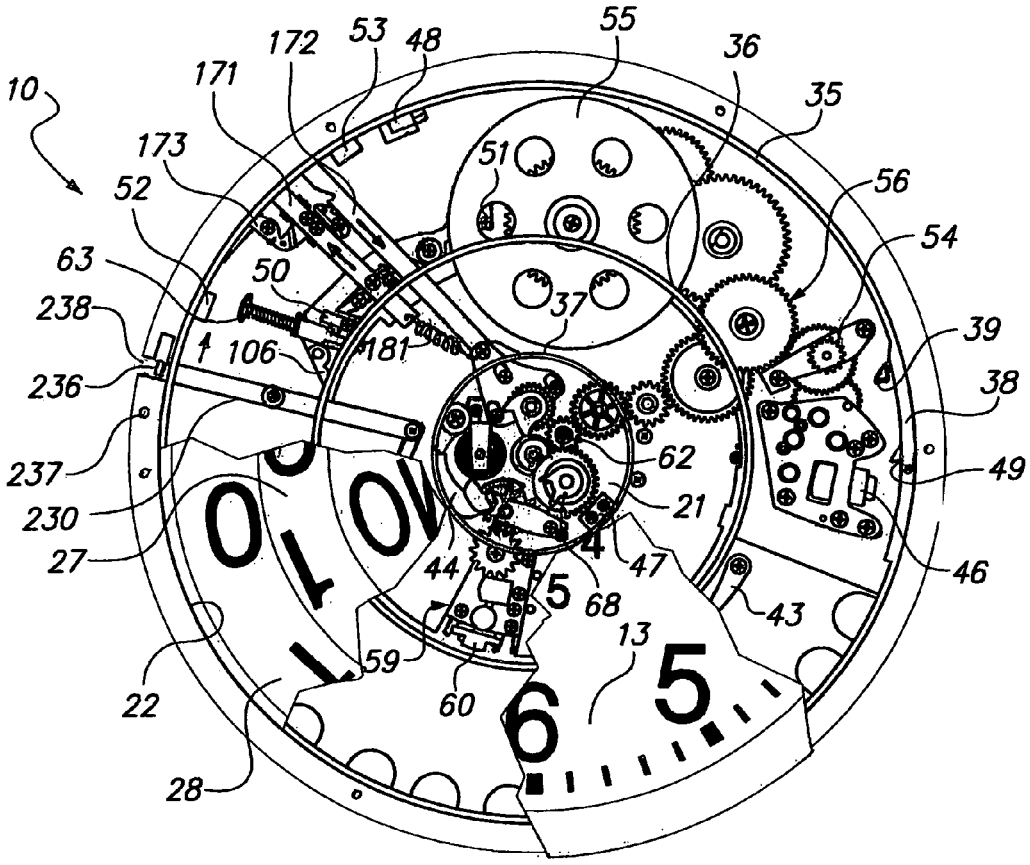
FIG. 1 is a cutaway front elevation view of wall clock with clock dial, day disc, tens disc, and units disc truncated to show the interior mechanisms of wall clock.
Figure 2:
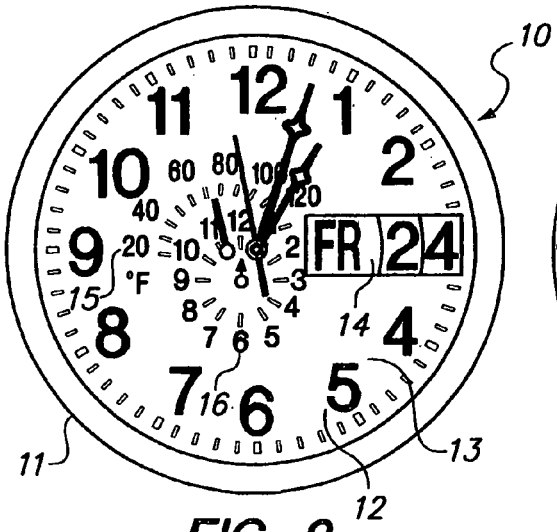
FIG. 2 is a front elevation view of wall clock.
Figure 3:
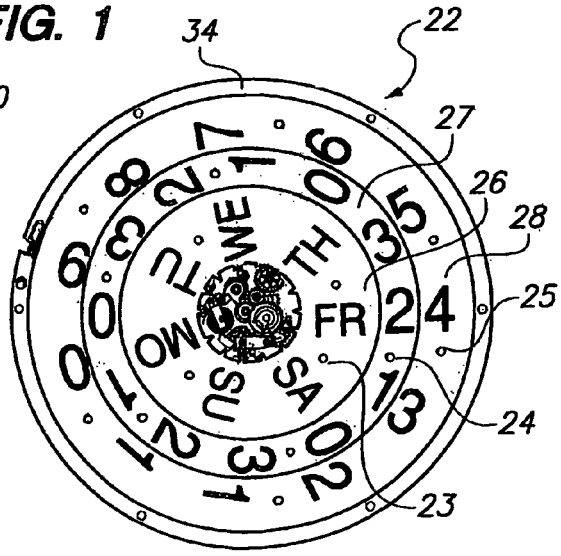
FIG. 3 is a front elevation view of wall clock without clock dial to show the front surface of day disc, tens disc, and units disc.

The wall clock of this invention is seen in whole or in part in all of the figures. FIG. 1 is used to help generally explain the clock with its mechanism.

Figure 4:
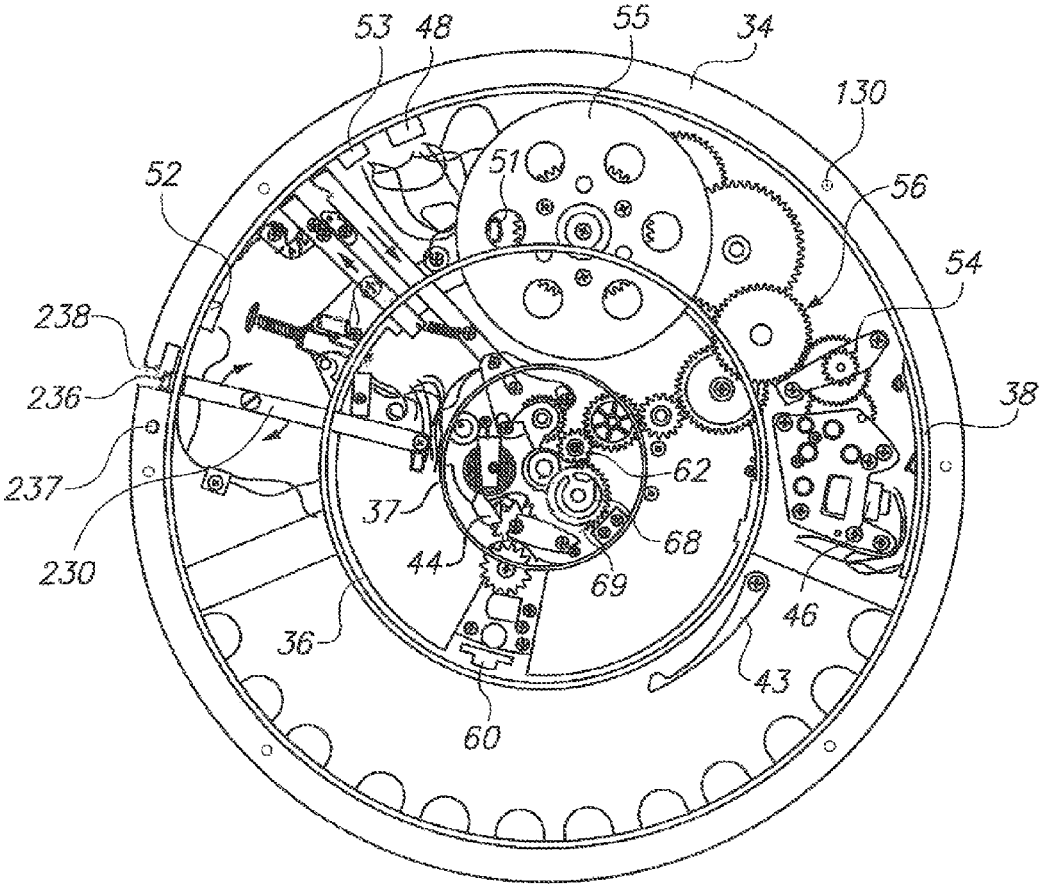
FIG. 4 is a front elevation view of wall clock without clock dial, day disc, tens disc, and units disc depicting the perpetual calendar mechanism.
Figure 6:
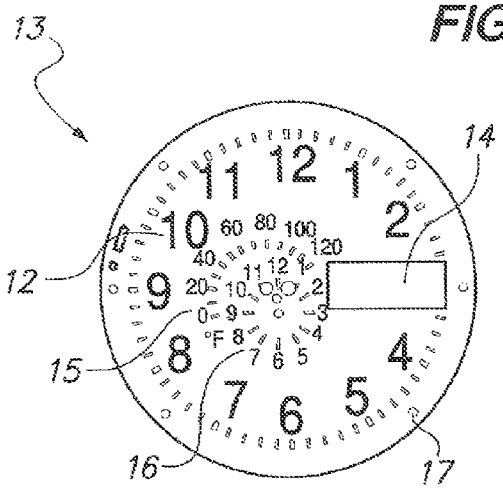
FIG. 6 is a front elevation view of clock dial.
Figure 5:
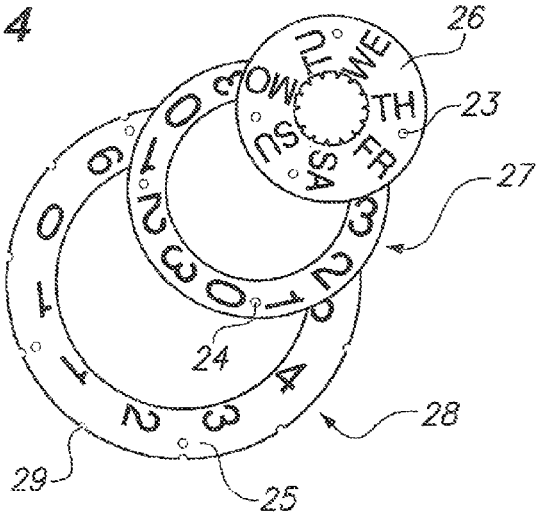
FIG. 5 is an exploded view of day disc, tens disc, and units disc.

FIGS. 1 and 4 show the wall clock 10 comprises an outer case 22 that is a rigid cylindrical-shaped member with one closed end and one open end. A flange 34 and a ring 35 are mounted to the open end of the outer case 22. A circular intermediate wall 36 and a circular inner wall 37 are mounted above the inner surface of the closed end of the outer case 22, where each circular wall is concentric with the center axis of the outer case 22.

Figures 7, 8, 9, 10:
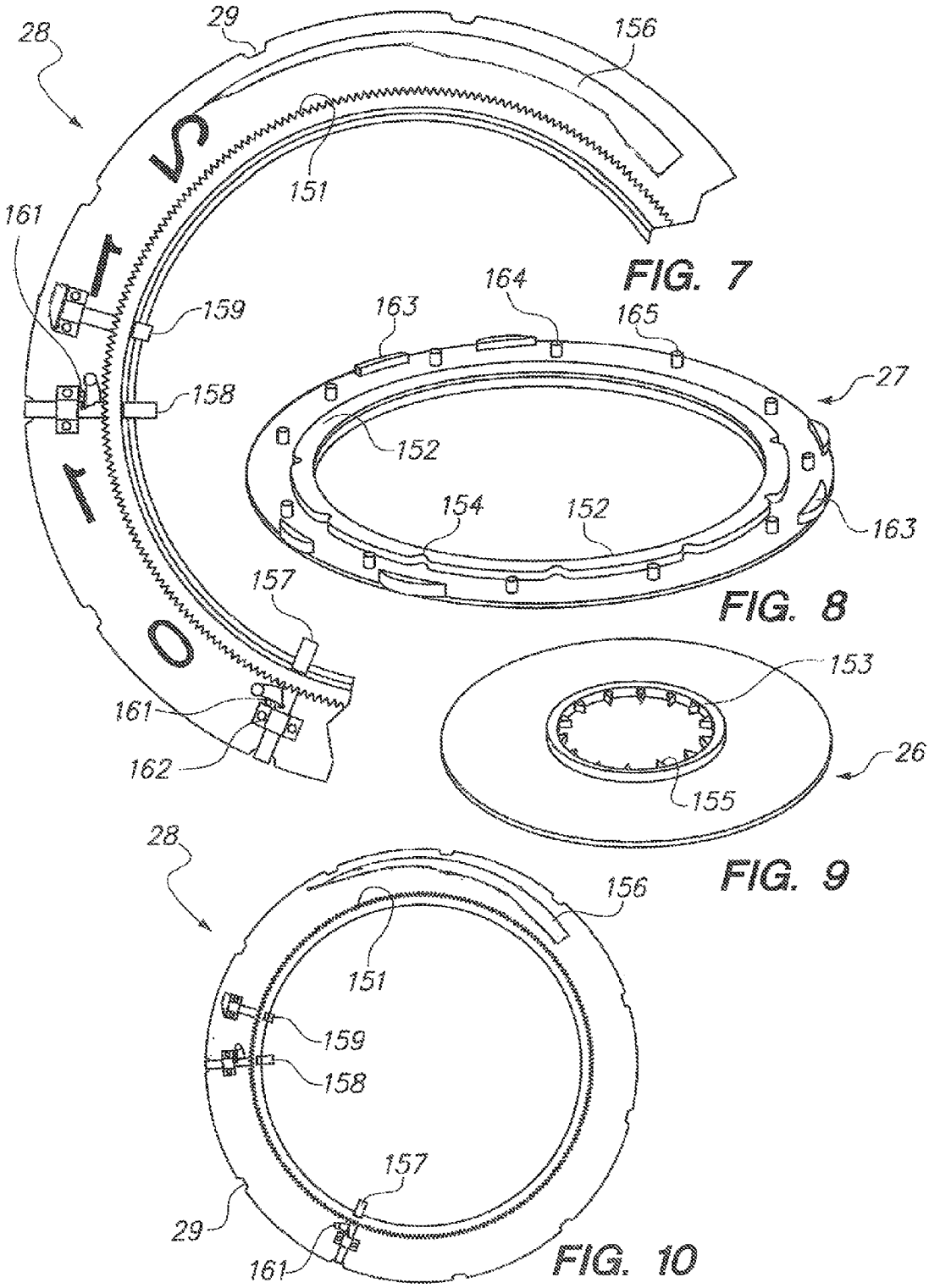
FIG. 7 is a cutaway rear elevation view of units disc.
FIG. 8 is a rear perspective view of tens disc.
FIG. 9 is a rear perspective view of day disc.
FIG. 10 is a rear elevation view of units disc.
Figure 11:
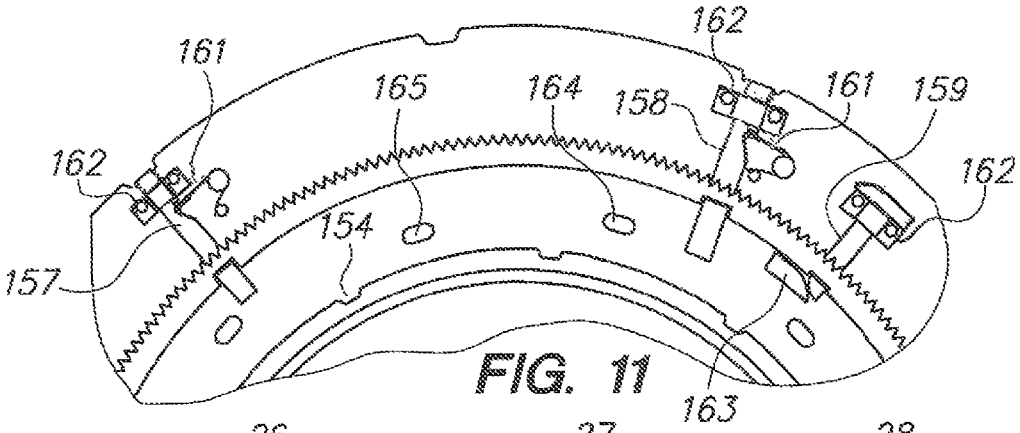
FIG. 11 is a partial rear elevation view of tens disc installed within units disc to show first, second, and third movable pins on units disc, and first and second catches and cams on tens disc.
Figure 12:
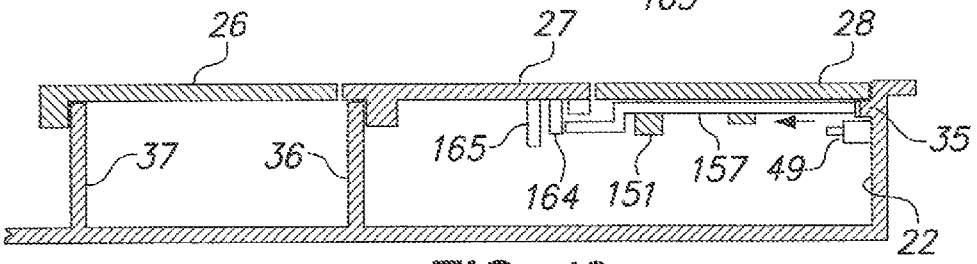
FIG. 12 is a pseudo cross sectional view of first movable pin on the units disc taken along its longitudinal center with first movable pin in a non-actuating position, depicting spatially how first movable pin clears first and second catches on tens disc and all cams on tens disc as the two discs are rotated relative to each other.
Figure 13:
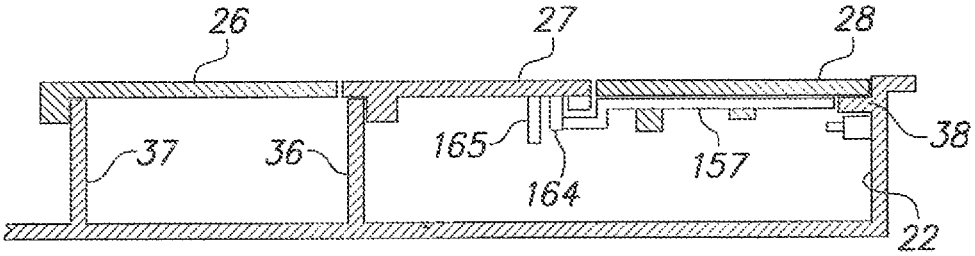
FIG. 13 is a pseudo cross sectional view of first movable pin on the units disc taken along its longitudinal center with first movable pin in an actuating position, depicting spatially how first movable pin engages first catch on the tens disc, clears the second catch on the tens disc, and clears all cams on the tens disc as the two discs are rotated relative to each other.
Figure 14:
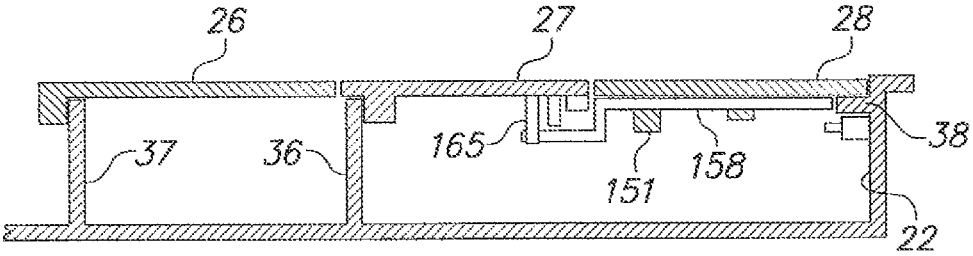
FIG. 14 is a pseudo cross sectional view of the second movable pin on the units disc taken along its longitudinal center with second movable pin in an actuating position, depicting spatially how second movable pin clears first catch on the tens disc, engages the second catch on the tens disc, and clears all cams on the tens disc as the two discs are rotated relative to each other.
Figure 15:
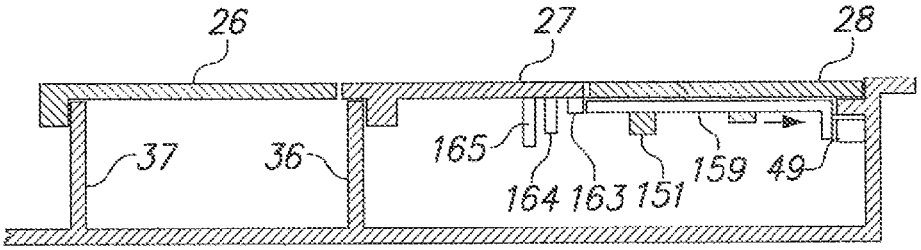
FIG. 15 is a pseudo cross sectional view of third movable pin on the units disc taken along its longitudinal center with third movable pin in an actuating position, depicting spatially how third movable pin clears first and second catches on tens disc, but engages a cam on tens disc to cause contact with a third switch mounted inside of the outer case to turn the third switch ON allowing the units disc to continuously rotate.

Wall clock 10 further comprises a day disc 26, a tens disc 27, and a units disc 28. The discs 26, 27, and 28 are rigid disc-shaped members, each of which has a center hole therein. The disc 26 has a ring 153 on its rear surface, as seen in FIG. 9. The disc 26 is rotatably disposed above the circular inner wall 37, so that the outer circumference of the gear ring 153 forms a slip fit with the inner circumference of the circular inner wall 37. The tens disc 27 has a ring 152 on its rear surface, as seen in FIG. 8. The tens disc 27 is rotatably disposed above the circular intermediate wall 36, so that the inner circumference of the ring 152 forms a slip fit with the outer circumference of the circular intermediate wall 36. The units disc 28 has a rear surface as seen in FIGS. 7 and 10. The disc 28 is rotatably disposed above the ring 35 and the outer circumference of the units disc 28 forms a slip fit with the inner circumference of the outer case 22.

The front surface of the disc 26 has a visual depiction of the seven days of the week, such as MO, TU, WE, TH, FR, SA, SU equally spaced around the full front surface of the disc 26. Seven small spacer bumps 23 exist on the front surface of the disc 26, one placed between the two names of the days of the week, so that they are equally spaced around on the front surface of the day disc.

The front surface of the tens disc 27 has a visual depiction of three sets of the number sequence 0, 1, 2, 3 equally spaced around on the full front surface of the disc. Twelve small spacer bumps 24 exist on the front surface of tens disc 27, one placed between two numbers, so that they are equally spaced around on the front surface of the tens disc.

The front surface of the units disc 28 has a visual depiction of the number sequence 0, 1, 1, 2, 3, 4, 5, 6, 7, 8, 9 equally spaced around on the front surface of the disc. Eleven small spacer bumps 25 exist on the front surface of units disc 28, one placed between two numbers, so that they are equally spaced around on the front surface of the disc.

Spacer bumps 23, 24 and 25 are provided to prevent the entire surfaces of discs 26, 27, and 28 from contacting the rear surface of a clock dial 13 and allow the discs to rotate easier with less friction.

Wall clock 10 further comprises a clock dial 13. Clock dial 13 is a rigid disc-shaped member with a date window 14, a temperature hole 73, a month hole 74, and screw holes 20. Clock dial 13 further comprises a temperature scale depiction 15 on its front surface. Wall clock 10 further comprises a temperature hand 17. Clock dial 13 further comprises a month scale depiction 16 on its front surface. Wall clock 10 further comprises a month indicator hand 18. Clock dial 13 further comprises an hour scale depiction 12 on its front surface. Wall clock 10 further comprises a second hand, a minute hand, and an hour hand. Hands are rigid oblong members with one end attached to a drive mechanism and the other end referencing a point on the respective scale depiction. All scale depictions are on the front surface of the clock dial 13, which is disposed above the flange 34 on outer case 22, so as screw holes 20 on the clock dial 13 fit with holes 130 made into the flange 34 of the outer case 22.

Figure 25:
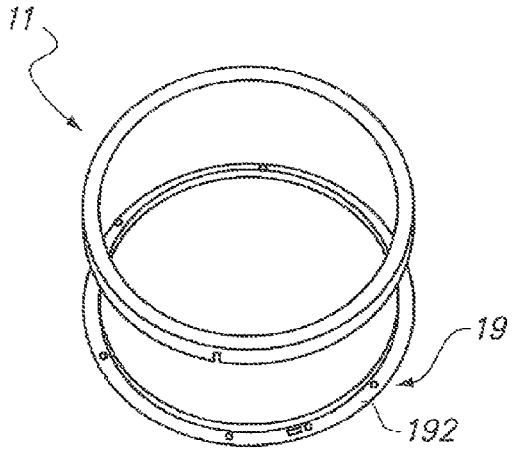
FIG. 25 is an exploded perspective view of a retainer ring and a clock ring.
Figure 26:
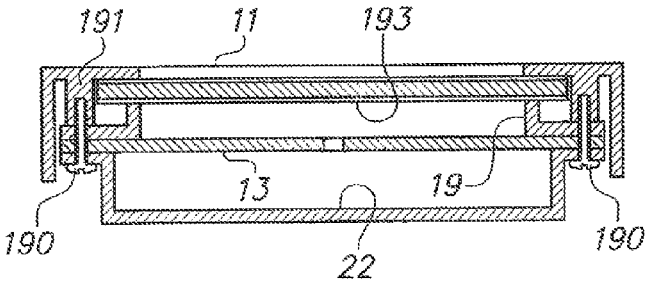
FIG. 26 is a cross sectional view of an assembled wall clock taken along the center bisection of the wall clock.

Wall clock 10 further comprises a retainer ring 19 and a clock cover ring 11 as seen in FIGS. 25 and 26. Retainer ring 19 has holes 192. Clock cover ring 11 has nut members 191. Retainer ring 19 is disposed above the clock dial 13, so as the holes 192 align with screw holes 20 on the clock dial 13. Wall clock 10 further comprises a clock cover disc 193 made of glass or clear plastic which is disposed above the retainer ring 19. The clock cover ring 11 with the nuts 119 is disposed above the clock cover disc 193, so that the inner periphery of clock cover ring 11 engages with the front surface of clock cover disc 193, and the nut members 191 engage screws 190 inserted through holes 130 on flange 34 of outer case 22, the screw holes 20 on the clock dial 13 and the holes 192 on the retainer ring 19, to secure the clock cover disc 193.

FIGS. 7-10 show the rear surfaces of day disc 26, tens disc 27 and units disc 28. The rear surface of the disc 26 includes a ring 153. Ring 153 is a specially shaped ridge or raised surface in the rear surface of day disc 26. The inner periphery of ring 153 includes teeth protruding therefrom to form a gear ring 155. The gear ring 155 functions to drive the day disc 26.

The rear surface of the tens disc 27 includes first catches 164, second catches 165, cams 163 and a ring 152. Ring 152 is a specially shaped ridge or raised surface in the rear surface of tens disc 27. The outer periphery of the ring 152 includes notches 154.

The rear surface of the units disc 28 includes a gear ring 151 for driving the disc 28, a three-step cam 156, a first movable pin 157, a second movable pin 158, and a third movable pin 159. Notches 29 exist on the outer periphery of units disc 28. Notches 29 function to control the rotation of units disc 28.

Three-step cam 156 is a raised area on the rear surface of units disc 28. The raised area is in the form of three steps with a rounded increment between two steps, so that a wheel could pass onto the raised area and transition between the three steps, rolling smoothly without getting hung up on any corners between the three steps. The three-step cam 156 is depicted in FIG. 7.

First movable pin 157 is movably mounted between the numbers 0 and 9 on the units disc 28 (seen in from front surface) by a claim 162 and inserted through a hole in the gear ring 151 on units disc 28. A spring 161 is mounted and arranged to press the first movable pin 157 radially outwardly to the outer periphery of the units disc 28. Second movable pin 158 is movably mounted between the two 1's on the units disc 28 (seen in from front surface), by another clamp 162 and inserted through a hole in the gear ring 151 on units disc 28. Another spring 161 is mounted to press the second movable pin 158 radially outwardly to the outer periphery of the units disc 28 to the limit of moving thereof. Third movable pin 159 is movably mounted close to the right side of the second movable pin 158, by another clamp 162 and inserted through a hole on the gear ring 151. The third movable pin 159 is a free to move outwardly or inwardly as engaged by other structure.

Wall clock 10 further comprises a quartz clock movement is positioned inside the circular wall 37 and engaged with inner surface of the closed end of the cylindrical-shaped member of outer case 22. Quartz clock movement has an hour adjusting stem wheel 195, depicted in FIG. 46, which is rotatably fixed in a hole in the closed end of the cylindrical-shaped member of the outer case 22. Quartz clock movement has rotating drive shafts or pins that are attached to the second, minute, and hour hands.

Wall clock 10 further comprises a holding disc or cover plate 21. The cover plate 21 is a rigid disc-shaped member with a center hole, where an hour shaft passes there through, pin holes, where pins from quartz clock movement pass there through, and screw holes used to secure the plate 21 to the outer case 22. Holding disc 21 is disposed above quartz clock movement, so that the pins on the clock movement pass through the pin holes on holding disc 21. The outer periphery of holding disc 21 is fitted to the inner side of the circular wall 37 with screws inserted through screw holes on holding disc 21 and threaded into long nuts on the bottom of the outer case 22 to secure the holding disc 21 and quartz clock movement.

Wall clock 10 further comprises a day gear train 56 that drives the discs 26 and 28. The day gear train 56 comprises a gear wheel 62, a first drive assembly 57, and a second drive assembly 58.

Figure 19:
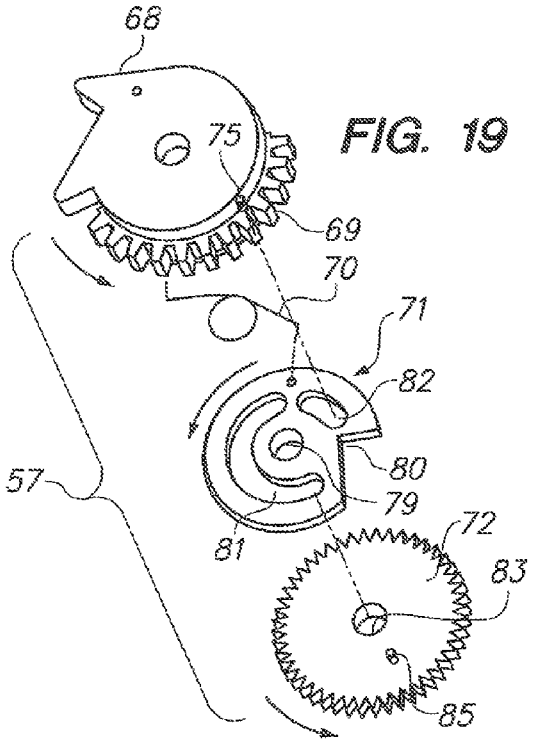
FIG. 19 is an exploded perspective view of the first drive assembly.
Figure 20:
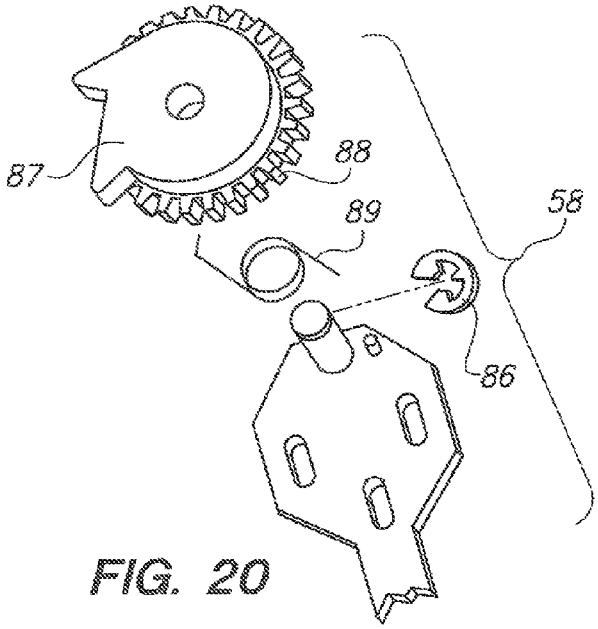
FIG. 20 is an exploded perspective view of the second drive assembly.

First drive assembly 57 is depicted in FIGS. 19-19C. First drive assembly 57 comprises a 24-hour gear wheel 72 with a short catch 85, and a center hole 83, and a control switch wheel 71 with a first long curved slot 81, a second long curved slot 82, a center hole 79, and a notch 80 therein. The switch wheel 71 is coaxially and rotatably disposed above the 24-hour gear wheel 72, so that the short catch 85 is placed within the first long curved slot 81. First drive assembly 57 further comprises a driven wheel 69 with radial teeth occupying about half of the outer circumference of the driven wheel 69, and bearing a short catch 75. Driven wheel 69 is coaxially and rotatably disposed above the control switch wheel 71, so that the short catch 75 is placed within second long curved slot 82. First drive assembly 57 further comprises a spring 70 that is coaxially disposed between the driven wheel 69 and the control switch wheel 71 to connect these wheels together. First drive assembly 57 further comprises a two-tooth wheel 68 that coaxially disposed above driven wheel 69 and secured to driven wheel 69. A lock ring holds the first assembly 57 in place on the pin. Gear wheel 62 engages with driven wheel 69 and two tooth wheel 68 engages gear ring 151 on the day disc 26 at midnight to drive the day disc 26.

First long curved slot 81 allows the control switch wheel 71, when being driven by the wheel 69, to rotate relative to the 24-hour gear wheel 72 still driven by the 12-hour gear wheel 76. The second long curved slot 82 with short catch 75 therein, allows and keeps control switch wheel 71 rotating, even when the spring 70 may not have enough energy to support control switch wheel 71 causing it to jump down a lever of the switch called the first switch 47. Normally, the spring 70 keeps the wheel 69 rotating, whenever control switch wheel 71 is driven by 24-hour wheel 72. The second slot 82 allows the 24-hour gear wheel 72 to drive the control switch wheel 71 when the driven wheel 69 is stopped, since the first tooth of the driven wheel 69 engages gear wheel 62 of the day gear train 56. Whenever the day gear train 56 starts to drive, the spring 70 forces the driven wheel 69 against the wheel 62. Further details will be explained below.

Second drive assembly 58 comprises a drive wheel 88 and a two-tooth wheel 87 coaxially and rotatably disposed above and secured to the wheel 88 for driving the day disc 26. A lock ring 86 holds the drive assembly 58 in place on the pin. When first drive assembly 57 releases from day gear train 56, after finishing a drive, and the drive assembly 58 engages day gear train 56 to drive day disc 26 for correcting the day of the week after the battery sets replaced.

Figure 46:
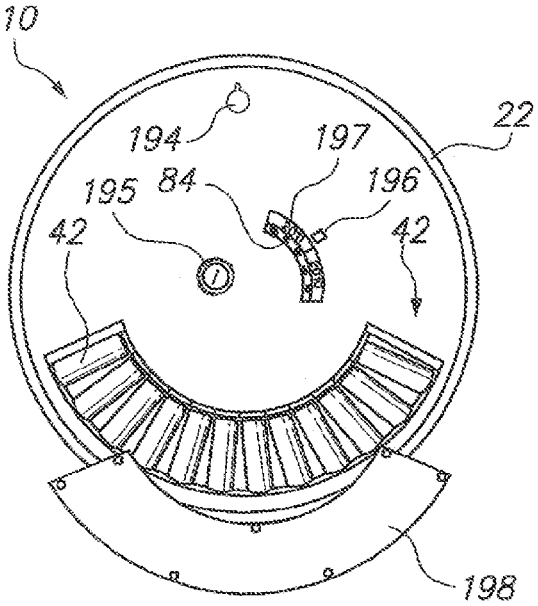
FIG. 46 is a rear elevation view of wall clock showing a battery house.
Figure 47:
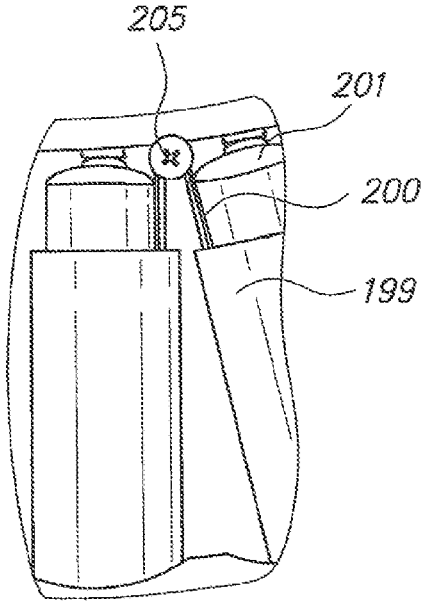
FIG. 47 is a blow-up view of battery house depicting the battery negative connectors.

The outer case 22 further comprises a battery house 42 which holds the battery sets. The battery house 42 is formed inside the outer case 22 with a housing battery cover 198 in the back of the clock 10, as seen in FIG. 46.

Figure 16:
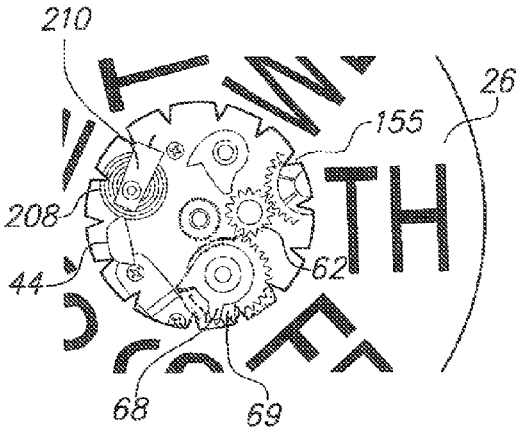
FIGS. 16-18 are enlarged top plan views of wall clock without clock dial depicting day gear train with 24-hour gear wheel, where FIGS. 16-18 respectively show the progression of 24-hour gear wheel rotating and thereby driving the rotation of day disc.
Figure 17:
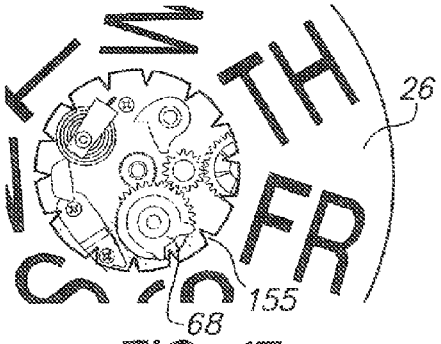
Figure 18:
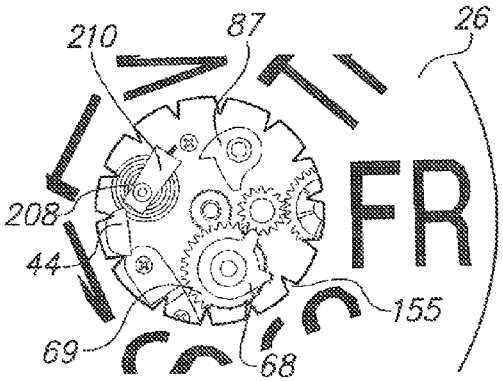

Wall clock 10 further comprises a drive motor 46 for driving the day gear train 56, a first switch 47, and a second switch 48. The switch 47 is mounted on the holding disc 21, so that the lever of first switch 47 is engaged with the outer side of control switch wheel 71. At midnight, the lever of first switch 47 jumps into notch 80 on control switch wheel 71, which is driven by the 24-hour gear wheel 72, to turn first switch 47 ON, causing drive motor 46 to start to drive the day gear train 56. A pair of gear wheels of the day gear train 56 has a top gear wheel 54 engaged with a gear ring 151 on the rear surface of the units disc 28 to drive units disc 28. While units disc 28 is rotating, this causes the second switch 48 to turn ON, prior to first switch 47 switching OFF. While the driven wheel 69 is driven by gear wheel 62 of day gear train 56, the lever of first switch 47 slides in notch 80, raising the outer side of control switch wheel 71, causing the first switch 47 to turn OFF. The day gear train 56 continuously drives day disc 26 until the last tooth of two-tooth wheel 68 has released gear ring 155, as seen in FIGS. 16-18. A jumper 44, which is controlled by a spring 133, jumps into an interstice of gear ring 155 to keep disc 26 in the correct position. Units disc 28 continuously rotates until the current day of the month appears in the day-date window 14, and the switch 48 switches OFF.

Second switch 48 is mounted to the inner side of the outer case 22. The lever of second switch 48 is extended and forms of a round end 31. The round end is entered to a notch 29 on units disc 28. Whenever units disc 28 rotates, the round end 31 allows units disc 28 to rotate over and press on the round end 31, causing second switch 48 to switch ON and whenever round end 31 jumps into the notch 29 on the units disc 28, the second switch 48 is switched OFF.

There are two number 1's on the units disc 28. The number 1 next to 0 is called the first number 1, and the other number 1, next to 2, called the second number 1. Whenever the number 1 or 2 on the tens disc 27 and the first number 1 on the units disc 28, appear through the date window at the same time (corresponding to days 11 and 21), the second number 1 on the units disc 28 will be passed. While the units disc 28 is rotating, one end of third movable pin 159 on the disc 28 slides over the outer side of the cam 163 on the tens disc 27, causing the other end of the third movable pin 159 to actuate a switch called the third switch 49 ON, allowing the units disc to rotate to pass the second number 1, so the number 2 appears through the date window 14. As stated above, the third movable pin 159 is free moving within the limit thereof. To avoid the third movable pin 159 unexpectedly contacting the third switch 49, a bump 39 is mounted to the inner side of the outer case 22, and located before the third switch 49, as seen in FIG. 1.

When the number 0, 1, or 2 on the disc 27, is displayed with the number 9 on the units disc 28 at the same time (corresponding to days 09, 19 and 29), the tens disc 27 will be driven. While the units disc 28 is rotating, one end of the first movable pin 157 on the units disc 28 slides over the side of a long cam 38, which is formed to the inner side of the ring 35, causing the other end of first movable pin 157 to engage with the catch 164 on tens disc 27, and drives the tens disc 27 to the next unit thereof. First movable pin 157 is released after it has passed the long cam 38 and before the units disc stops. A jumper 43 (see FIG. 4), which is control by a spring, jumps into the notch 154 on the ring 152, to keep the tens disc 27 in correct position thereof.

When the number 3 on the tens disc 27 is displayed with the first number 1 on the units disc 28 at the same time (corresponding to day 31), the tens disc 27 will be driven. While the units disc 28 is rotating, one end of the second movable pin 158 on the units disc 28 slides over the side of the long cam 38, causing the other end of second movable pin 158 to engage with the catch 165 on the tens disc 27, and drives the tens disc 27 to the next unit thereof. Second movable pin 158 is released after it has passed the long cam 38.

Figure 21:
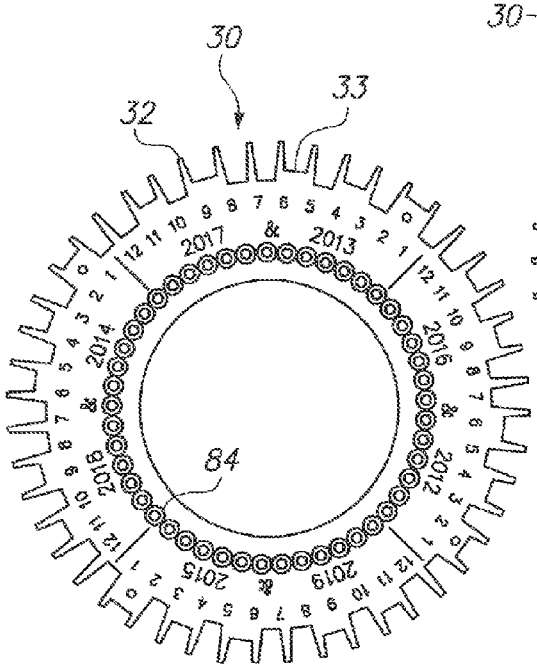
FIG. 21 is a rear elevation view of a calendar cam.

Wall clock 10 further comprises a calendar cam 30, as depicted in FIG. 21. The cam 30 is a rigid disc-shaped member with forty-eight teeth 32 and forty-eight interstices 33 positioned radially along its outer circumference. The depths of the interstices 33 are various, which depend on the lengths of the months along a four years scale accounting for a leap year. The shallowest depths of the interstices 33 called the first depths, for controlling the corrections of the ends of the months having 28 days. The second depth is for the months having 29 days. The third depths are for the months having 30 days, and the deepest depths are for the months having 31 days.

Figure 34:
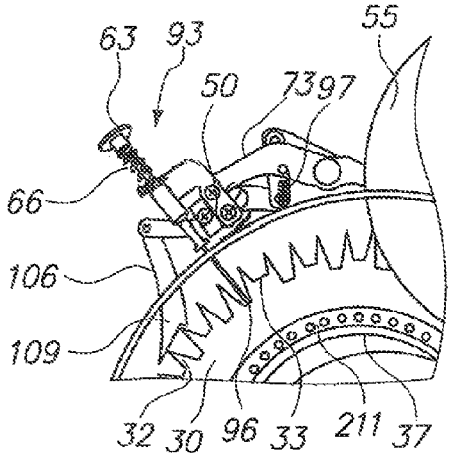
FIG. 34 is an enlarged view of control switch assembly mounted on wall clock, with control arm portion in the lower position.
Figure 32:
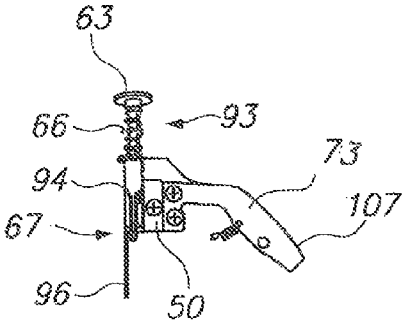
FIG. 32 is a perspective view of the control arm portion.
Figure 35:
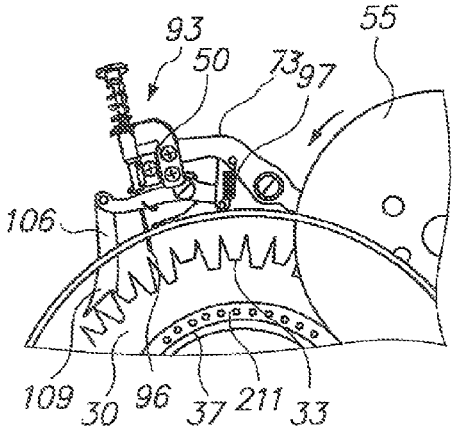
FIG. 35 is an enlarged view of a control switch assembly mounted on wall clock, with the control arm portion in the upper position.
Figure 33:
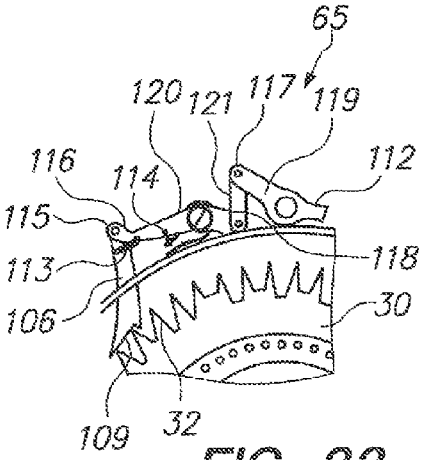
FIG. 33 is an enlarged view of a cam drive assembly mounted on the wall clock.
Figure 36:
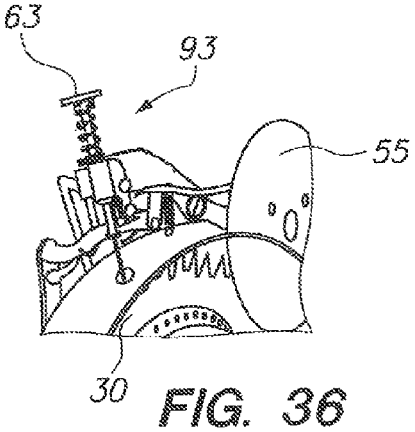
FIG. 36 is a perspective view of control switch assembly mounted on wall clock.
Figure 37:
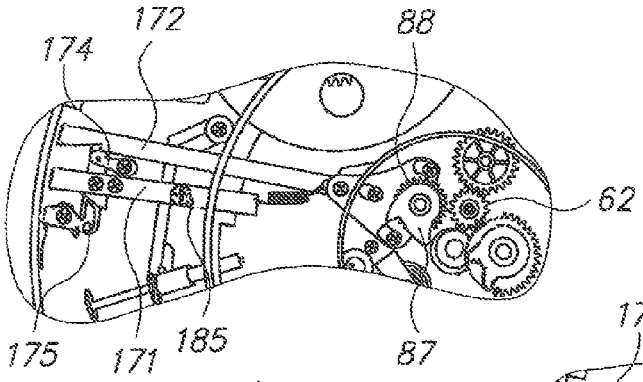
FIG. 37 is an enlarged cutaway view of a day disc gear train at a point when the day disc gear train is released.
Figure 38:
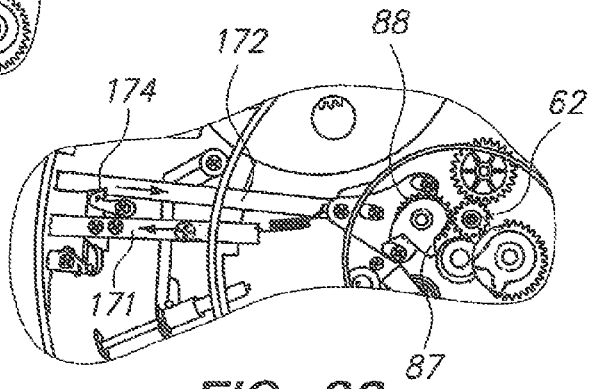
FIG. 38 is an enlarged cutaway view of day disc gear train at a point when the wheel connector bar is pushed, the second drive wheel engages the gear train, and the wheel connector bar is locked by the auto lock mechanism.
Figure 39:
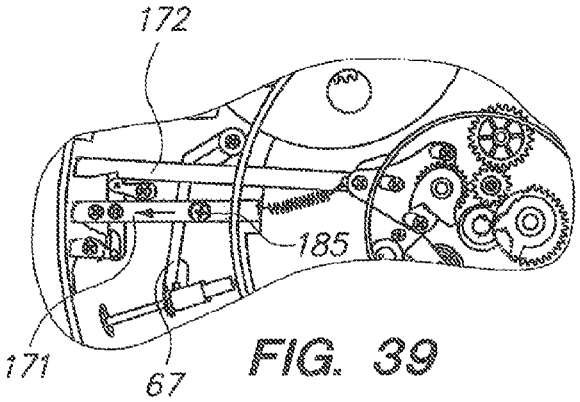
FIG. 39 is an enlarged cutaway of day disc gear train with the control bar pulled out, the control arm portion is lifted to move the end of the control arm portion out of an interstice of the calendar cam, and the control bar is locked by the auto lock mechanism.

Calendar cam 30 is rotatably disposed above the bottom of the outer case 22. The inner periphery of the cam 30 forms a slip fit with the outer side of the circular wall 37. A ring 211 is secured to the inner side of the front surface of the calendar cam 30, so that the top side of the ring 211 rotatably engages with the rear surface of a cam cover disc 40, to keep the cam 30 is rotatable in the position thereof, as seen in FIG. 34.

Wall clock 10 further comprises a control switch assembly 64, as depicted in FIGS. 31-36, which controls the correction of the end of the month, and a cam drive assembly 65, which drives the calendar cam 30 to rotate one tooth each month.

Cam drive assembly 65 includes a control drive portion 119 which has one end rotatably mounted to a post mounted to the bottom of the case 22. A finger 112 extends from this end of the control drive portion 119 to cooperate with a long cam 98 on a control disc 55 to rotate the control drive portion 119 to move a cam driver 106 for rotating the calendar cam 30. Between the control drive portion 119 and cam driver 106 are a connector arm 121 and a bell crank 120. Bell crank 120 is rotatably mounted to a post mounted to the bottom of the outer case 22 with a spring 141 thereon. The spring 141 helps the bell crank 120 return to its original position after completing a cam drive operation.

Connector arm 121 has one end 117 rotatably connected to one end 122 of the control drive portion 119 by a rivet. The other end 118 of connector arm 121 is rotatably connected to one end of the bell crank 120 by another rivet. The cam driver 106 has one end 116 rotatably connected to the other end 115 of the bell crank 120 by another rivet. A spring 113 is connected to both of the cam driver 106 and the bell crank 120 together, to force the other end 109 of the cam driver 106 to engage with the teeth 32 of the calendar cam 30.

Control switch assembly 64 includes a control arm portion 67 with a movable pin 93 and a switch 50 thereon. Movable pin 93 has a round collar 94 movably mounted between a pair of brackets to engage with the fourth switch 50. Whenever movable pin 93 is moved or slid, it actuates fourth switch 50. A small wheel or head 63 is mounted to the top end of the movable pin 93 to cooperate with a three-step cam 156 on the units disc 28 to control the fourth switch 50, as depicted in FIGS. 42-45. Head 63 also keeps a coil spring 66 in place, which provides outward radial pressure on the movable pin 93 to insure proper engagement. Coil spring 66 also helps the pin 93 to return to the original position thereof, after the three-step cam has passed the head 63.

Control arm portion 67 includes one end coaxially, rotatably mounted over the finger 112 of control drive portion 119. This end of the control arm portion 67 is extended to form a finger 107. When the finger 107 engages the long cam 98, the control arm 67 is rotated, lifting the other end 96 of the control arm portion 67 out of the interstice 33 of the calendar cam 30 (see FIG. 35), to allow the cam driver 106 to rotate the cam 30. A spring 97 is connected to the control arm portion 67, to force the end 96 of the control arm portion 67 to turn back and to engage with the next bottom of the interstice 33, when the control arm portion 67 is released.

Figure 30:
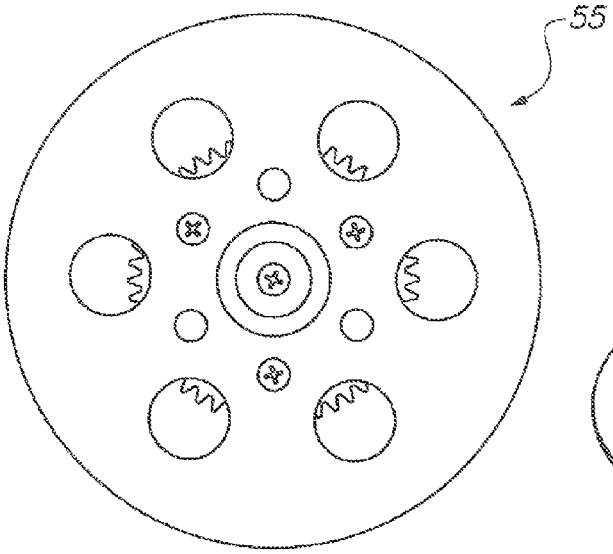
FIG. 30 is a front elevation view of the control disc.
Figure 29:
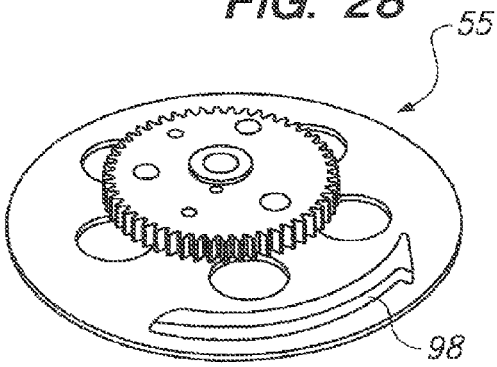
FIG. 29 is a rear perspective view of a control disc.
Figure 31:
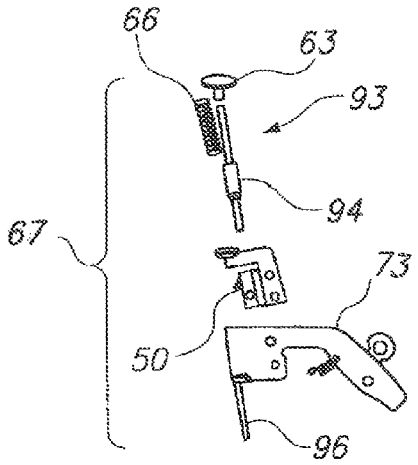
FIG. 31 is an exploded enlarged perspective view of a control arm portion.

Control disc 55 is a two concentric disc assembly where one disc is smaller with gear teeth on the outer circumference thereof, and the other disc is larger with a long cam 98 on the adjacent surface to the smaller gear, as depicted in FIGS. 29 and 30. The control disc 55 is driven by the day gear train 56, and makes one revolution per month.

The units disc 28 makes three complete revolutions each month, so the three-step cam 156 passes the head 63 of the movable pin 93 three times each month. To avoid an incorrect date display, a fifth switch 51 is provided. A lever of the fifth switch 51 is located to cooperate with the long cam 98 on the control disc 55 to actuate fifth switch 51 ON or OF, and the fifth switch 51 is wired in series with fourth switch 50 and the drive motor 46. Normally, fifth switch is OFF and the circuit electrical line is disconnected. Fifth switch 51 is only ON during the last four days of per month (days 28, 29, 30, and 31). During these days, the long cam 98 on the control disc 55 engages the lever of the switch 51, causing the switch 51 to turn ON.

Figure 42:
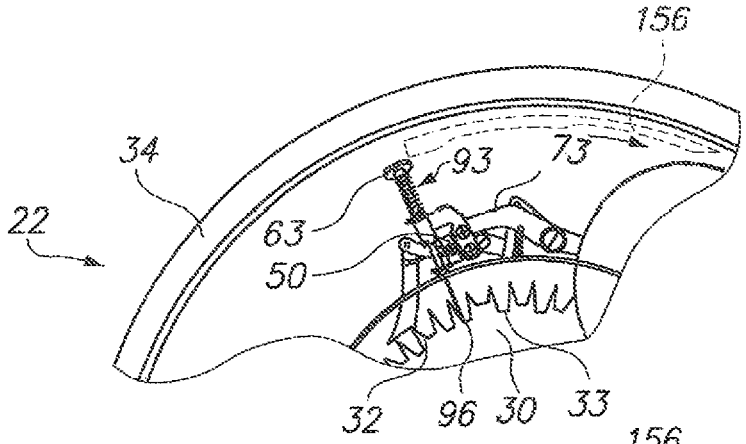
FIG. 42 is an enlarged cutaway view depicting the three-step cam on the units disc as it passes the small wheel on the top of a movable pin without actuating the fourth switch.

FIGS. 42-45 depict the control processes of the-end-of the-month correction mechanism. In FIG. 42, the current month has 31 days, so no correction is necessary. Three-step cam 156 on the units disc 28 will freely pass head 63 on the top end of the movable pin 93 without contacting or actuating the fourth switch 50. This is because the depth of the interstice 33 is sufficiently deep that movable pin 93 and head 63 will be in the full lowered position.

Figure 43:
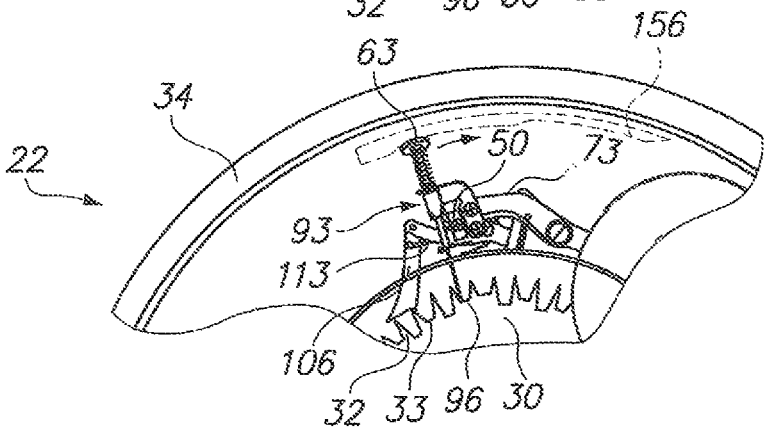

In FIG. 43, the current month has 30 days. This means the end 96 of the control arm portion 67 is engaged with the bottom of the interstice 33 of the cam 30, corresponding to a month having 30 days. Thus, the control arm portion 67 and the movable pin 93 mounted thereon are rotated higher one increment. Thus, while the units disc 28 is rotating to pass the $30^{th}$ day of the month, and before the disc 28 were stopped at the $31^{st}$ day of the month, the first step of the three-step cam 156 engages with the head 63 of the pin 93, causing the fourth switch 50 to turn ON. Since the fifth switch 51 is already in ON position, the units disc 28 continuously rotates, causing the second switch 48 to turn ON. Then the fourth switch 50 is turned OFF when the three-step cam has passed the head 63. This allows the disc 28 to rotate one additional display number to pass the $31^{st}$ day and to indicate the first day of the next month.

Figure 44:
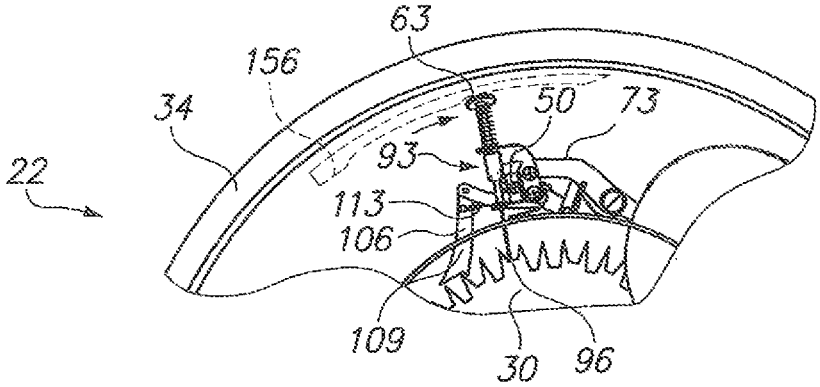

In FIG. 44, the current month has 29 days. This means, the end 96 of the control arm portion 67 is engaged with the bottom of the next shallower interstice, corresponding to a month having 29 days. This means the control arm portion 67 is rotated higher one more increment. Thus, while the units disc 28 is rotating to pass the $29^{th}$ day, and before the units disc 28 were stopped at the $30^{th}$ day, the second step of three-step cam 156 engages the head 63 of the movable pin 93, causing the switch 50 to turn ON. This allows the units disc 28 to rotate two additional display numbers to pass the $30^{th}$ and $31^{st}$ days, to indicate the first day of the next month.

Figure 45:
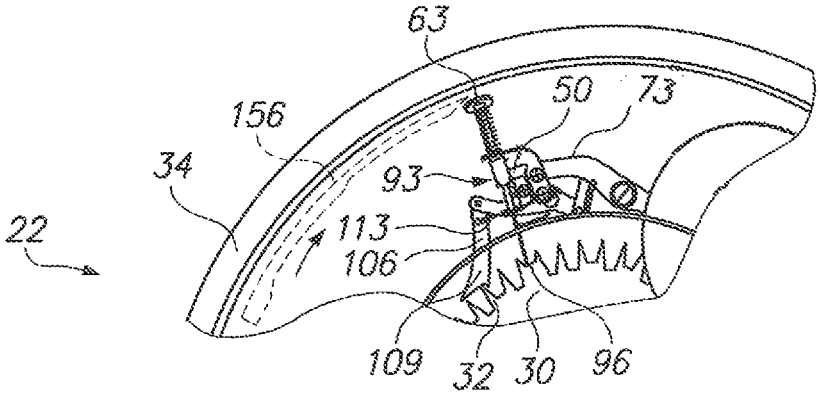

In FIG. 45, the current month has 28 days. This means, the control arm portion 67 is engaged with the bottom of the shallowest interstice of the calendar cam 30, corresponding to a month having 28 days. This means the control arm portion 67 is raised to the highest increment. Thus, when the units disc 28 is rotating to pass the $28^{th}$ day, and before the disc 28 were stopped at the $29^{th}$ day, the third step of the three-step cam 156 engages with the head 63 of the movable pin 93, causing the fourth switch 50 to turn ON, allowing the units disc 28 to rotate three additional display numbers to pass the $29^{th}$, $30^{th}$, and $31^{st}$ days, to indicate the first day of the next month.

While the units disc 28 is rotating to pass the $31^{st}$ day, to indicate the first day of the next month, long cam 98 on control disc 55 engages the finger 107 of the control arm 67, causing the control arm portion 67 to lift the other end 96 out of interstice 33 of calendar cam 30. Then long cam 98 engages finger 112 of control drive portion 119, causing cam driver 106 to push on the tooth 32 of calendar cam 30 to advance calendar cam 30 by one tooth. Calendar cam 30 is rectified by a jumper 219 jumping to the interstice of the calendar cam 30.

When long cam 98 on control disc 55 has passed the fingers 107 and 112, control drive portion 119 returns to its original position and the end 96 of the control arm portion 67 returns to its normal position and engages the bottom of the next interstice 33. This completes the end-of-the-month correction mechanism.

Figure 27:
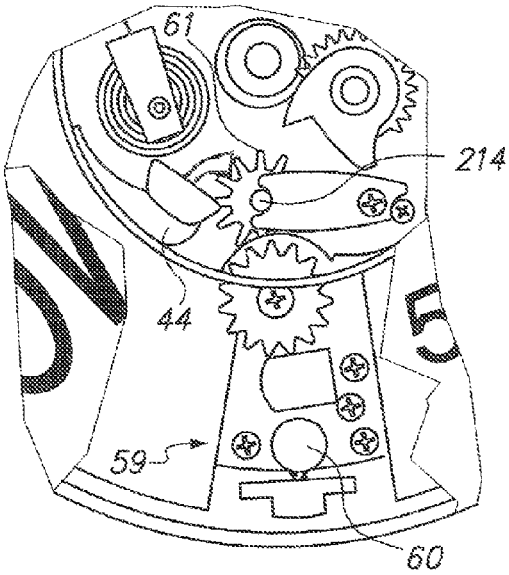
FIG. 27 is an enlarged cutaway front elevation view of wall clock depicting the gear train for month indicator hand with first and last gears.
Figure 28:
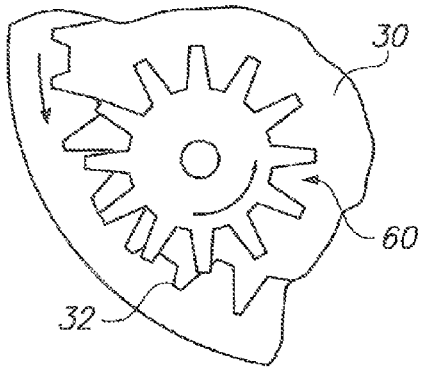
FIG. 28 is an enlarged cutaway front elevation view of wall clock depicting the first gear of the gear train for month indicator hand engaging a tooth on the calendar cam.

Wall clock 10 further comprises a month gear train 59 for driving a month indicator hand 18, as seen in FIGS. 27 and 28. Gear train for driving a month indicator hand 18 has a first gear wheel 60 engaged teeth 32 of calendar cam 30 and a last gear wheel 61. Once a month, calendar cam 30 is rotatably advanced one tooth, thus first gear 60 and last gear 61, each is also driven one tooth. Last gear wheel 61 has twelve teeth and a center hole, with a shaft 214 rigidly mounted there through, which is rotatably mounted to the cover plate 21. A bracket 216 is mounted to the cover plate 21 to secure gear wheel 61 and shaft 214 in place for rotation. A rotatably mounted, spring-loaded foot 215 is mounted on the cover plate 21, engaging the last gear wheel 61 to maintain the gear wheel 61 in the correct position between month changes. The month indicator hand 18 is mounted to the top of the shaft 214 after the clock dial 13 is assembled.

After battery sets are replaced, the indicated time should be adjusted for accuracy. A stem wheel 195 on the back of the clock 10 is used for this.

The indicated day, date, and month are adjusted as follows. The day gear train 56 has a wheel connector bar 172 inserted through a hole in the side of the outer case 22, then through another hole in the side of the circular wall 36, and then rotatably connected to a wheel holding plate 182, by a two-step screw 183, which is inserted through a hole in the wheel holding plate 182, then driven into a bore threaded into the end of the wheel connector bar 172. The other end of the wheel connector bar 172 protrudes through the case 22 to form a square end 177. A spring 181 is connected to the wheel connector bar 172 to force wheel connector bar 172 back after an auto lock 174 is released.

Wheel holding plate 182 has three long apertures thereon, and two-step screws are inserted through these long apertures, then driven into bores threaded into the holding disc 21, and allowing the wheel holding plate 182 to move within the limit thereof. An axle 95 is mounted to the wheel holding plate 182, and rotatably fixed inside the center hole of the second drive assembly 58, and a lock ring 86 is mounted to the top of the axle 95.

Auto lock 174 comprises a lock portion 187, which is a rigid oblong member. Lock portion 187 has one end with a screw hole through, which is mounted by a two-step screw inserted there through and driven into a long nut mounted to the bottom of the outer case 22. The other end of lock portion 187 is rotatably connected to one end of a connector bar 188 by a rivet. The other end of control bar 188 is rotatably connected to one end of the lock release portion 123. The other end 173 of lock release portion 123 is inserted through a hole in the side of the outer case 22 for controlling the lock release portion 123 by hand. A spring 124 is inserted over a long nut mounted on the bottom of outer case 22 where a two-step screw 186 is inserted through a hole in the lock release portion 123 then thread into the long nut to rotatably mount the lock release portion 123. Spring 124 has one end connected to the lock release portion 123 and the other is engaged with the inner side of the outer case 22 for forcing the lock portion 187 to lock the wheel connector bar 172, also to force the lock release portion 123 to turn back after the end 173 is pushed to release the auto lock 174.

When the indicated day and date need to be adjusted, the square end of the wheel connector bar 172 is pushed by hand, to engage the drive wheel 88 with the gear wheel 62 of the day gear train 56 where the auto lock 174 automatically locks wheel connector bar 172, then turn a switch, called the sixth switch 53 ON, the gear train starts to drive, then turn OFF about two seconds later (at this time, the second switch 48 is ON), so the units disc 28 rotates until a day and date change is completed. The second switch 48 is automatically turned OFF. The auto lock 174 is released by pushing the lock release handle 173 located outer side of the outer case 22. If the indicated day and date indicating need to be adjusted by more than one day, leave the switch 53 ON until the current day of the week completely appears through the date window 14, release the auto lock 174, and keep the switch 53 ON until the current day of the month begins to appear through the date window 14 then turn switch 53 OFF (the second switch 48 is still ON), so the units disc 28 still rotates until the current date completely appears through the date window 14, then the second switch 48 is turned OFF.

When auto lock 174 is released, the two-tooth wheel 87 stops rotating. To avoid locking the day disc 26 when the day disc 26 is driven by another two-tooth wheel 68 at midnight. A spring 89 is coaxially disposed between the wheel holding plate 182 and the drive wheel 88. One end of the spring 89 is connected to the drive wheel 88, the other end of the spring 89 is free moving. A catch 90 is arranged and mounted to the wheel holding plate 182. The catch 90 cooperates with the free moving end of the spring 89 to prevent the two-tooth wheel 87 from locking the day disc 26. When the two-tooth wheel 87 is stopped at the problem location, spring 89 forces two-tooth wheel 87 to rotate backward when auto lock 174 is released. Normally, the free moving end of the spring 89 passes the catch 90, while two-tooth wheel 87 is rotating to indicate the day of the week.

Figure 40:
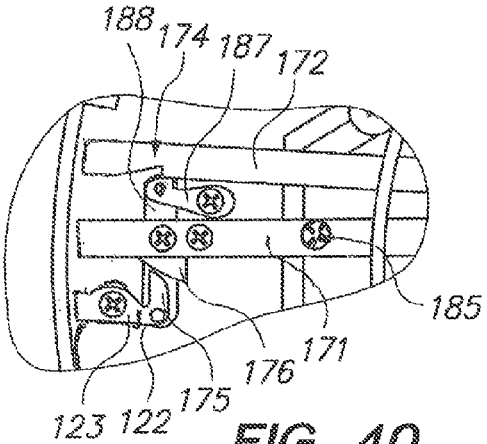
FIG. 40 is an enlarged cutaway view of the auto lock mechanism.
Figure 41:
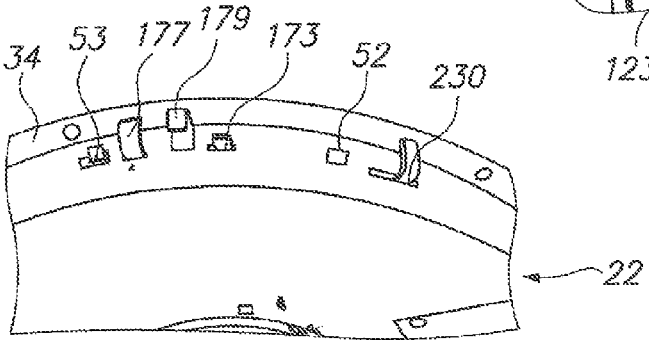
FIG. 41 is an enlarged view of the outer side of wall clock depicting the exposed ends of bars and switches.

The indicated month is adjusted as follows. The rear surface of calendar cam 30 has month, year figures of forty-eight months for four years including a leap year. Each month figure has a small hole 84, threaded through the calendar cam 30 for driving calendar cam 30 by hand. Windows 196 and 197 are made through the bottom of the outer case 22. The current month and year figures on the rear side of calendar cam 30 appear through windows 196 and 197. A control bar 171 is inserted through a hole in the side of outer case 22, then through another hole in the side of the circular wall 36. A long body screw 185 is driven through a bore threaded into the control bar 171, so that when control bar 171 is pulled out, the body of the screw 185 engages with the control arm portion 67 to lift the end 96 of the control arm portion 67 out of the interstice 33 of calendar cam 30. Lock release portion 123 has one end 175 engaged with a catch 111 attached to the control bar 171, and when the control bar 171 is pulled out completely, the end 175 of the lock release portion 123 jumps over the catch 111 to lock onto the bar 171. Catch 111 also limits the control bar 171 from moving out too much. The end 179 of the control bar 171, stays outside of outer case 22, and has a square end 177 to allow the control bar 171 to be pulled out by hand. The spring 181 has one end connected to the end of control bar 171 to force it back when released. Note: the lock release portion 123 can release two lock portions at the same time, as seen in FIG. 40.

After control bar 171 is pulled out and locked, turn the clock over to face the back of the clock, use a toothpick, pen, small nail or similar to insert into one of holes 84, made through the calendar cam 30 to hand drive calendar cam 30 clockwise until the current month and year appear through the windows 196 and 197. Then, release the auto lock.

Figure 51:
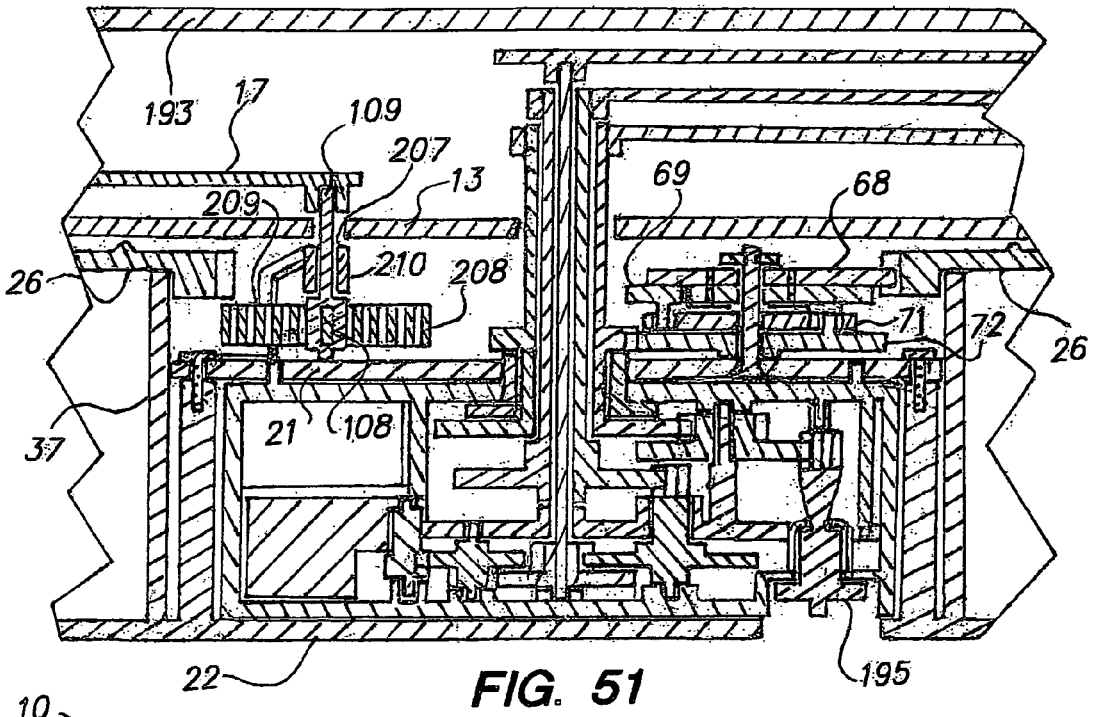
FIG. 51 is a pseudo cross sectional view of a temperature device.
Figure 52:
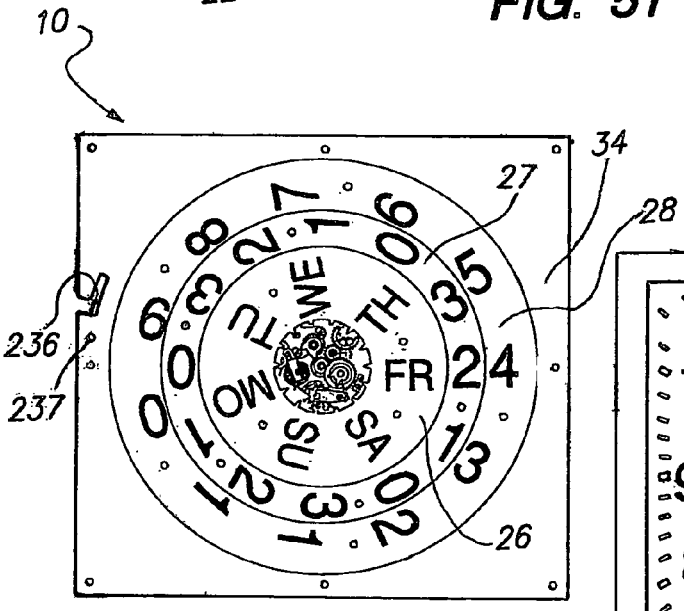
FIG. 52 is front elevation view of wall clock with square face with the clock dial removed.
Figure 53:
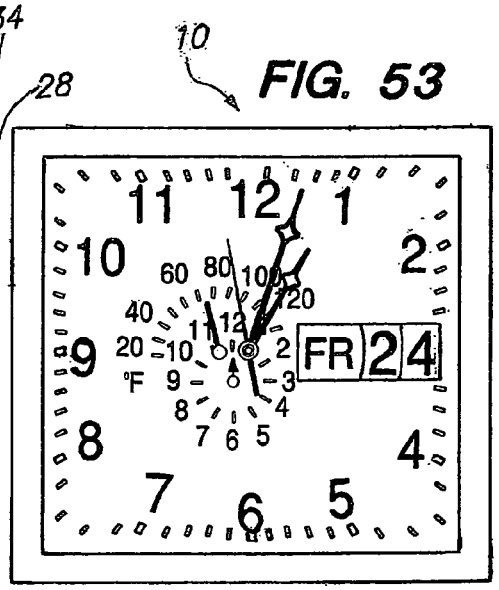
FIG. 53 is a front elevation view of wall clock with square face.

Wall clock 10 further comprises a temperature device 208 that has one end secured to an axle 108 located in the center thereof, and the other end is inserted through a hole 209, made into a holding portion 210 which is mounted on the holding disc 21. Axle 108 is rotatably inserted through a hole 207, and the temperature indicator hand 17 is mounted to the end 109 of the axle 108 for indicating current temperature, after clock dial 13 is assembled (see FIG. 51).

Figure 22:
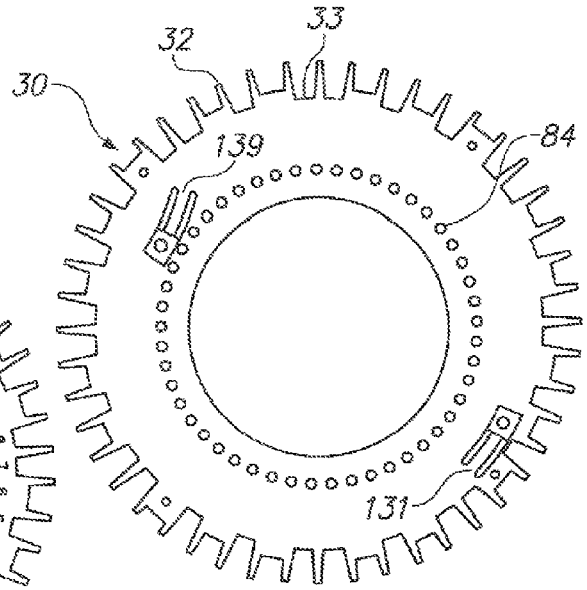
FIG. 22 is a front elevation view of the calendar cam.
Figure 23:
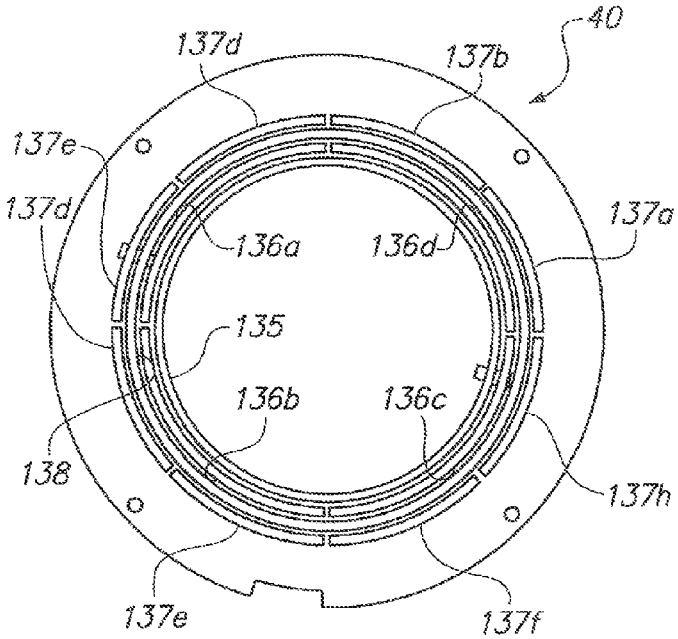
FIG. 23 is a rear elevation view of the cam cover disc.
Figure 24:
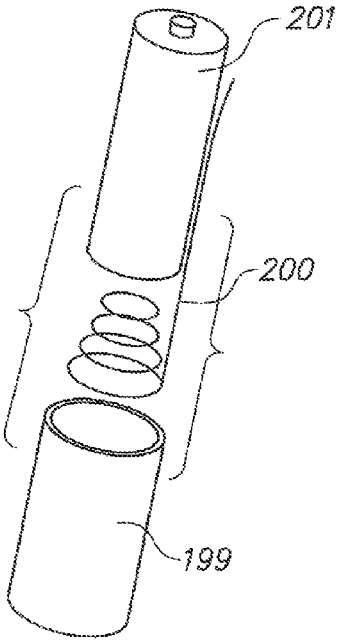
FIG. 24 is an exploded perspective view of a battery holder, a negative battery connector spring, and an AA battery.

Wall clock 10 is operated by two battery sets and designed to be replaced every four years. That is the time required for the calendar cam 30 to make one complete revolution. Referring to FIG. 22, the front surface of the calendar cam 30 includes a pair of brushes 131, 139. Brush 131 is for the drive motor battery set and the brush 139 is for quartz clock movement battery set. Brushes 131 and 139 contact respective pairs of conductor lines 206 and 212, mounted to the rear surface of cam cover disc 40. One line of per pair is a continuous connection line and the other line is divided into multiple segments, the length of each segment depends upon how a AA battery can reliably supply power before losing charge. For example, one battery 201 can provide power for quartz clock movement to work for one year, so four batteries will provide power in a four year operation. The divided segments are denoted by 212, and each segment is connected to a battery 201. The continuous connection line is connected to the quartz clock movement. Brush 139 connects each segment of the conductor lines to the continuous line to provide power to quartz clock movement. Power source is four AA batteries 201 for the quartz clock movement and eight AA batteries 201 for the drive motor. Thus, one line of the couple lines 206 for the drive motor is divided eight segments and brush 131 is used to connect them.

FIGS. 46-50 depict electrical components and a circuit diagram, showing per battery 201 is secured within a plastic housing 199, with a spring 200 in its lower end. Positive lines are connected to the positive connectors of the batteries 201. Negative lines are connected to springs 200 beneath the batteries. The positive lines that extend from the battery set to power the motor 46 include lines 137*a*, 137*b*, 137*c*, 137*d*, 137*e*, 137*f*, 137*g*, and 137*h*. One of these lines is connected to a respective one of the eight conductor segments. A positive return line 138 is connected to a main switch 52, said switches, then to the terminal of the motor 46. Brush 131 connects one segment leading to the line 137*e* to the continuous line interconnected to the line 138. In that manner, the battery 201 connected to the line 137*e* is interconnected to one terminal of the drive motor 46, through the various switches said above. All of the negative terminals of the batteries 201 are connected together, through a negative line 134, which interconnected both to the drive motor 46, and to the quartz clock movement.

Figure 48:
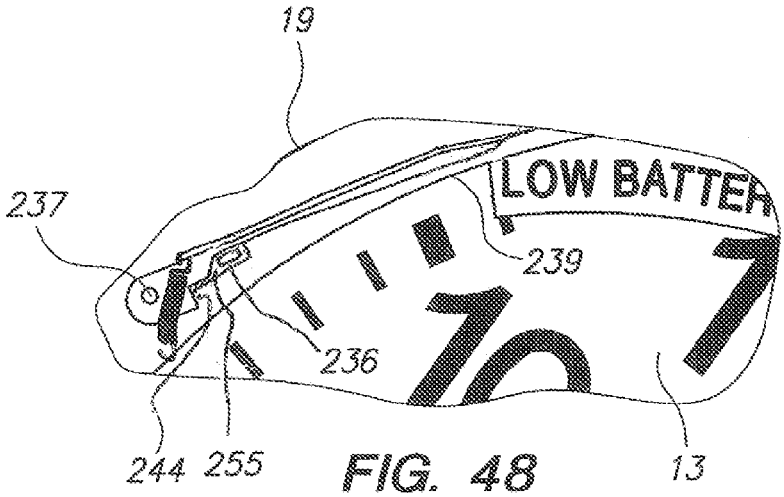
FIG. 48 is a blow-up view of low battery signal device.
Figure 49:
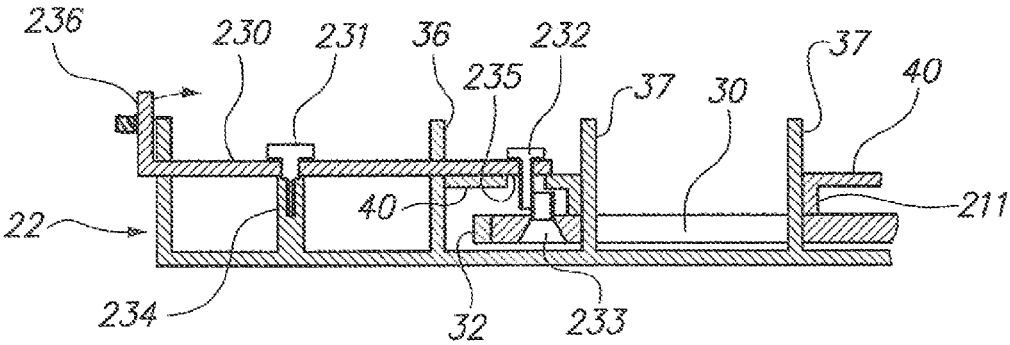
FIG. 49 is a pseudo cross sectional view depicting how the low battery signal device is controlled by the calendar cam.
Figure 50:
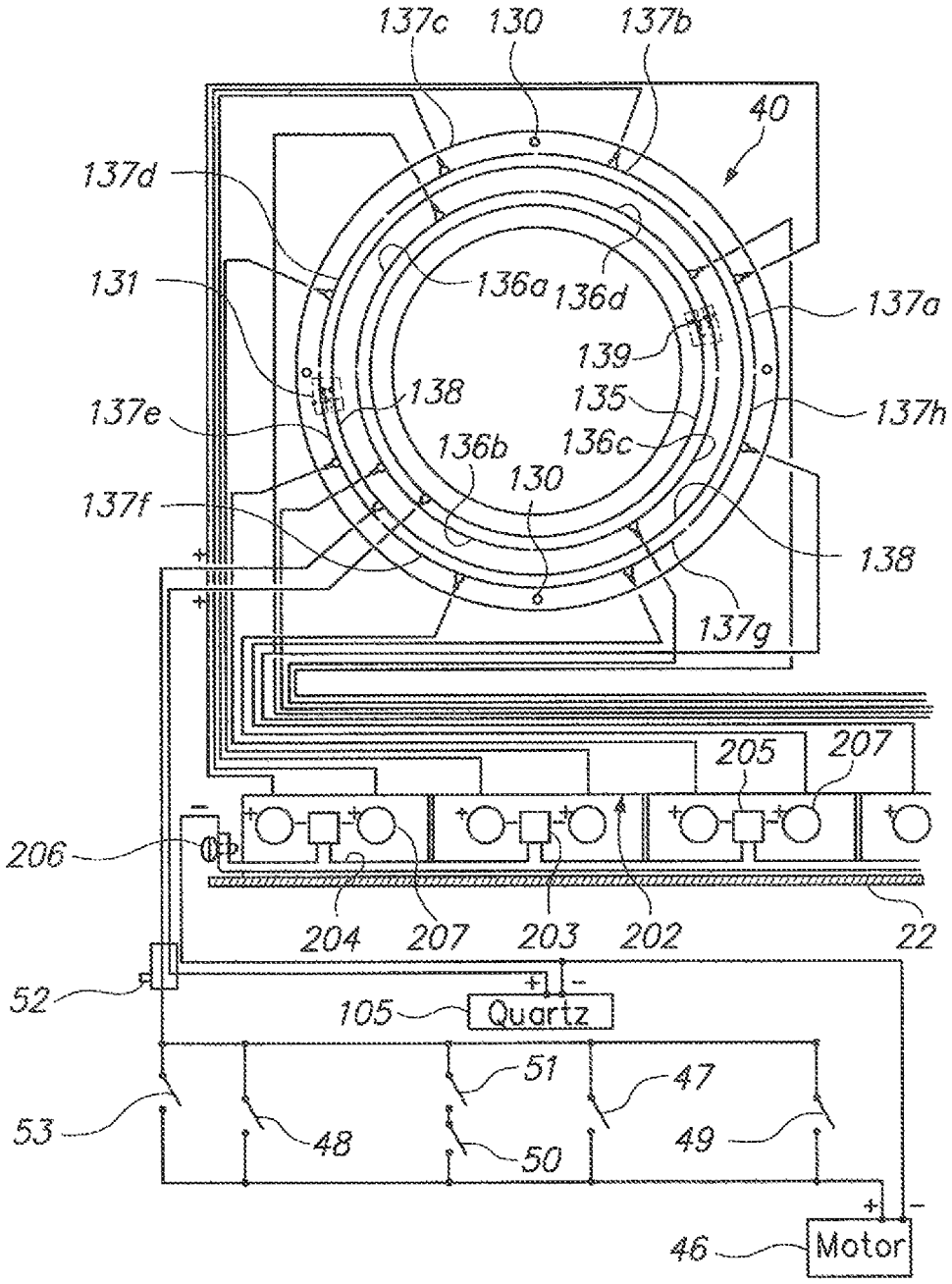
FIG. 50 is a circuit diagram or electrical schematic diagram of wall clock.

Wall clock 10 further comprises a low battery signal device depicted in FIGS. 48 and 49. Low battery signal device comprises a low battery signal flag 239 and a flag control bar 230. Flag control bar 230 is inserted through a long aperture on the wall side of the outer case 22, and through another long aperture on the wall side of the circular wall 36. The outer end 236 of the flag control bar 230 is bent up 90 degrees and pushed into a long aperture 238 on the flange 34 of the outer case 22. The other end of the flag control bar 230 carries a screw 232, the body of this screw 232 is inserted through a long aperture 235 made through the cover disc 40. Flag control bar 230 is rotatably mounted to a post 234 secured to the bottom of the outer case 22, by a two-step screw 231. An axle 237 is mounted to the topside of the flange 34 of outer case 22. Clock dial 13 has a hole 242 that axle 237 goes through and a long aperture 243 that the movable end 236 of the control bar 230 goes through. The wall side of the retainer ring 19 has a long aperture 256 that the sign LOW BATTERY goes through; the bottom side of the retainer ring 19 has a hole 254 and a long aperture 255. Retainer ring 19 is disposed over the clock dial 13 so as the axle 237 is inserted through the hole 254 and the long aperture 255 is passed through end 236 and fits to the long aperture 242 on the clock dial 13. One end of the low battery signal flag 239 has a hole 240 and a notch 244, the other end of the low battery signal flag 239 carries the words LOW BATTERY. Flag 239 is disposed over the bottom side of the retainer ring 19, so as the axle 237 is inside the hole 240. A lock ring 245 is mounted to axle 237. End 236 of flag control bar 230 is moved into the notch 244 to keep the flag up. A spring 241 is mounted to the flag 239 to pull down the flag when the end 236 of flag control bar 230 is moved out of the notch 244. A screw 233 is driven through a threaded hole 84 on the cam 30. While the cam 30 is rotating, the body of the screw 233 pushes and passes the body of the screw 232 mounted on the end of control flag bar 230, causing the other end 236 of flag control bar 230 to move out of the notch 244, causing the sign LOW BATTERY to fall down to appear over the clock dial 13. To reset the flag up, the elbow of the flag control bar 230 located at the outer side of the outer case 22 is pulled counter-clockwise.

An optional lower cost wall clock has the same features as the described above clock, but the batteries are replaced every year. This clock has a smaller battery house, holding only three batteries, one battery for the quartz clock movement, and two remaining batteries for the drive motor. However, if the clock is designed for one year battery replacement, four screws 233 are needed to mount on the calendar cam 30, so that the flag 239 will appear every year.

The invention claimed is:

1. Wall clock with perpetual calendar mechanism comprising:

an outer case being a rigid cylindrical-shaped member having a closed end and an open end, a circular intermediate wall and a circular inner wall, said walls being mounted upon said closed end and being concentric with said outer case, a flange and a ring, all of which being mounted to said open end;

a day disc, a tens disc and a units disc, each disc having a center hole, and being rotatably mounted above said circular inner wall, said circular intermediate wall and said ring;

a clock dial having a day-date window, a temperature, hour, month scale depictions on its front surface and being mounted above said open end;

a clock cover assembly having a clock cover disc, a retainer ring, and a clock cover ring, all of which being secured to the open end of said outer case;

a quartz clock movement being mounted inside of said circular inner wall and powered by a first battery set;

a day gear train having gear wheels, a first drive assembly and a second drive assembly;

a drive motor controlled by switches and powered by a second battery set;

a month gear train for driving a month indicator hand;

a calendar cam having forty-eight teeth and forty-eight interstices formed on its outer circumference, depths of said interstices are various, depending on the lengths of the months of four years including a leap year;

a cam drive assembly for driving said calendar cam; a control switch assembly having a control arm portion cooperating with a three step cam to correct the end of the month correction;

a temperature device having a temperature indicator hand for indicating the current temperature;

means for controlling said battery sets replaced every four years;

a battery house holding said battery sets with a housing cover in the back of said outer case;

a low battery signal device having a low battery signal flag presented every four years;

a day-date-month-adjustment assembly having means for adjusting the day, date and month depictions after the battery sets replaced.

2. Wall clock according to claim 1, wherein said day disc being rotatably disposed above said circular inner wall, which comprises a visual depiction of seven days of the week, namely MO, TU, WE, TH, FR, SA, SU equally spaced around on the front surface thereof, a small spacer bump formed between each adjacent name of the day of the week, a gear ring mounted to the inner circumference of said day disc, the outer circumference of said gear ring forms a slip fit with the inner circumference of said circular inner wall and a jumper engaged with the interstice of said ring to keep said day disc in position.

3. Wall clock according to claim 1, wherein said tens disc being rotatably disposed above said circular intermediate wall, which comprises first catches, second catches, cams, and a ring on the rear surface thereof, the outer circumference of said ring having notches, that a jumper engages to keep said tens disc in position, and the inner circumference of said ring forms a slip fit with the outer circumference of said circular intermediate wall, a visual depiction of three sets of the number sequence 0, 1, 2, 3 equally spaced around on the front surface of said tens disc with a spacer bump formed between each adjacent the two numbers, said center hole of said tens disc sized to accommodate and surround said day disc.

4. Wall clock according to claim 3, wherein said units disc being rotatably disposed above said ring on the open end of said outer case, with the outer circumference of said units disc forming a slip fit with the inner circumference of said outer case, said units disc comprises a visual depiction of the number sequence 0, 1, 1, 2, 3, 4, 5, 6, 7, 8, 9 equally spaced around on the front surface thereof, with a spacer bump formed between two numbers, and a notch made into the outer circumference of said units disc between the two numbers for controlling said units disc rotation, the rear surface of said units disc having a three-step cam with a rounded increment between two steps, a gear ring being engaged with said day gear train for driving said units disc, a first, second, and third movable pins selectively cooperating with said catches, cams on said tens disc to drive said tens disc and to control the rotation of said units disc, said center hole of said units disc sized to accommodate and surround said tens disc.

5. Wall clock according to claim 4, wherein said units disc has two number 1's on its front surface, the number 1 next to 0 called first number 1 and the number 1 next to 2 called second number 1, whenever said number 1 or 2 on the tens disc and the first number 1 on said units disc displayed within the day-date window at the same time, corresponding to days $11^{th}$ and $21^{st}$, said second number 1 will be past passed the day-date window before the next date displayed, while said units disc is rotating, one end of said third movable pin on said units disc sliding on the outer side of said cam on said tens disc, causing the other end of third movable pin actuating a switch called third switch to turn ON, this allows said units disc to continuously rotate to pass said second number 1.

6. Wall clock according to claim 4, wherein when the number 0, 1, or 2 on said tens disc and number 9 on said units disc are displayed at the same time, corresponding to days $9^{th}$, $19^{th}$ or $29^{th}$, said tens disc will be driven for displaying the next day, while said units disc is rotating, one end of said first movable pin on said units disc slides on the outer side of a cam mounted to said ring on said open end, it causes the other end of first movable pin engaging with the first catch on said tens disc and to drive said tens disc, said tens disc is also driven, when number 3 on said tens disc and the first number 1 on said units disc displayed at the same time, corresponding to day $31^{st}$, one end of said second movable pin on said units disc engages with the second catch on said tens disc to drive the disc.

7. Wall clock according to claim 3, wherein said clock dial has a rear surface arranged to engage with said spacer bumps on the front surfaces of said day disc, tens disc and units disc to keep these discs rotating in their positions.

8. Wall clock according to claim 1, wherein said units disc makes three complete revolutions each month and to avoid an incorrect date display, a fifth switch provided, normally, said fifth switch is OFF, and is ON only during the last four days of each month, at the time the lever of said fifth switch engaging with a cam on the rear surface of a control disc to actuate said fifth switch to turn ON, to connect the electrical line to the drive motor.

9. Wall clock according to claim 1, wherein said clock cover disc made of glass or clear plastic is disposed above said retainer ring, and retainer ring disposed above said clock dial, said clock cover ring secures said clock cover disc to said outer case.

10. Wall clock according to claim 1, wherein said quartz clock movement comprises an hour shaft with a 12-hour gear wheel thereon, a minute shaft, and a second shaft, a second hand, a minute hand and an hour hand, each hand has one end attached to its respective shaft and the remaining end of each hand referencing a point on its respective scale depiction, a wheel holding disc disposed above said clock movement to secure said clock movement to said outer case.

11. Wall clock according to claim 10, wherein said first drive assembly comprises a 24-hour gear wheel engaged with said 12-hour gear wheel, an axle mounted upon said wheel holding disc and passes there through a center hole of said 24-hour gear wheel, a control switch wheel having a first, second curved apertures therein, and a notch in the outer circumference thereof, said control switch wheel being coaxially, rotatably disposed above said 24-hour gear wheel, so that a short catch on said 24-hour gear wheel placed in the first curved aperture, a spring coaxially disposed above said control switch wheel, a driven wheel having radial teeth occupying about half of the outer circumference thereof, and a short catch thereon, said driven wheel being coaxially disposed above said spring, so that said short catch on said driven wheel placed in said second curved aperture, and said spring connects both said control switch wheel and driven wheel together, a two-tooth wheel coaxially disposed above and secured to said driven wheel for driving said day disc, a lock ring mounted to the top of said axle.

12. Wall clock according to claim 11, wherein said 24-hour gear wheel is driven by said 12-hour gear wheel, thus, at midnight, the first tooth of said driven wheel engages with said day gear train, and the lever of said first switch enters into the notch on said control switch wheel, causing said first switch to turn ON, said two-tooth wheel and units disc start to rotate, said units disc rotating, which causes a second switch to turn ON prior to said first switch to turn OFF, at the time the lever of said first switch slides in the notch of said control switch wheel and coming up the outer circumference of said control switch wheel, causing said first switch to turn OFF, said day disc and units disc continuously rotate until the current day and date completely displayed within said day-date window, at the time, said second switch has turned OFF as the lever of said second switch enters the notch on said units disc.

13. Wall clock according to claim 1, wherein said second drive assembly comprises a drive wheel, a two-tooth wheel and a spring, an axle that mounted above a movable wheel-holding-plate, passes there through the center hole of said spring, through center holes of drive wheel and two-tooth wheel, and said two wheels secured together, said second drive assembly engaged with said day gear train for driving the day disc to adjust the day depiction after said battery sets replaced, said spring having one end connected to said drive wheel, and the other end cooperating with a post mounted above said movable wheel-holding-plate to prevent said day disc from locking when said day disc driven by said first drive assembly.

14. Wall clock according to claim 1, wherein said month gear train includes a first and last gear wheels, said first gear wheel engaged with the teeth of said calendar cam and said last gear wheel having a shaft with a center hole therein, an axle mounted above said wheel holding disc, said axle is inserted into said center hole for rotation, and said shaft of the last gear wheel passes through a hole in said clock dial, one end of the month indicator hand is mounted to said shaft for indicating the month, and a jumper is engaged with the interstice of said last gear wheel to keep the wheel in position.

15. Wall clock according to claim 1, wherein said calendar cam further comprises a month and year scale depictions for four years, each is equally positioned around on the rear surface thereof, a bore made at each month indicator number, said calendar cam is rotatably disposed above the inner surface of said closed end of said outer case and the inner circumference of said calendar cam forms a slip fit with the outer circumference of said circular inner wall, a ring is rotatably secured above said calendar cam and a cam cover disc disposed above said ring to keep said calendar cam rotating in position.

16. Wall clock according to claim 15, wherein said means for controlling the battery sets includes a pair of brushes mounted above the front surface of said calendar cam providing electrical contacts with a first and second pairs of copper or brass conductor lines mounted upon the rear surface of said cam cover disc, said first pair of conductor lines having one continuous line connected to said clock movement and the other line divided into multiple segments, each segment connected to a respective battery, said second pair of said conductor lines having one continuous line connected to said drive motor after connecting to selective switches, and the remaining line divided into multiple segments, each segment connected to a respective battery.

17. Wall clock according to claim 1, wherein said cam drive assembly includes a control drive portion having one end rotatably mounted to a post on said closed end, and this end is extended and formed of a finger, the other end rotatably connected to one end of a connector bar, the remaining end of said connector bar is rotatably connected to one end of a bell crank, the other end of said bell crank rotatably connected to one end of a cam driver, a spring connects said bell crank to said cam driver to force the other end of said cam driver to engage with the teeth of said calendar cam for driving said calendar cam, said bell crank is rotatably connected to a post mounted on the inner surface of said closed end by a two-step screw, with a spring thereon, said spring forces the bell crank to return to its original position after completing a drive operation.

18. Wall clock according to claim 1, wherein said control switch assembly comprises a control arm portion with a fourth switch and a movable pin thereon, said movable pin having a long rounded collar movably mounted between a pair of brackets mounted to said control arm portion, the actuating portion of said fourth switch engaged with the lower end of said long rounded collar, whenever said collar moving downwardly said fourth switch to turn ON, a coil spring mounted to said movable pin and a wheel mounted to the top of said movable pin.

19. Wall clock according to claim 18, wherein said control switch assembly cooperating with both the interstice of said calendar cam and said three-step cam on said units disc to correct the end-of-the month correction; if the month having 31 days, no correction will be done; if the month having 30 days, the end of said control arm portion engaging with the bottom of the interstice of said calendar cam having one shallower increment; if the month having 29 days, the end of said control arm portion engaging with the bottom of the interstice having one more increment shallower; if the month having 28 days, the end engaging with the bottom of the shallowest interstice, while said units disc is rotating, said three-step cam on said units disc impinges upon the top end of said movable pin, it causes the fourth switch on said control arm portion to turn ON, allowing said units disc to continuously rotate to correct the end-of-the month correction.

20. Wall clock according to claim 1, wherein said temperature device has one end connected to the end of an axle located in the center of said temperature device, the remaining end movably inserted through a hole in a holding portion mounted above said wheel holding disc, said axle is rotatably inserted through another hole in said holding portion and passes there through a hole in said clock dial, one end of the temperature indictor hand is mounted to the end of said axle for indicating temperature.

21. Wall clock according to claim 1, wherein said low battery signal device comprises a low battery signal flag having one end rotatably mounted to an axle mounted above said flange of said outer case, a flag control bar being rotatably connected to a post on the inner surface of said closed end, one end of said flag control bar mounted a screw and the remaining end entered a notch in said battery signal flag to keep the flag disappearing on said clock dial, a screw, which mounted to said calendar cam, pushes and passes said screw on said flag control bar to move the other end of said control bar out of said notch on said battery signal flag, allowing said low battery signal flag to display over said clock dial by forcing of a spring mounted to the low battery signal flag.

22. Wall clock according to claim 1, wherein said day-date-month adjustment assembly comprises an auto lock, a wheel connector bar, and a control bar, said auto lock having two lock portions rotatably mounted to posts on the inner surface of said closed end of said outer case, a connector bar rotatably connecting both said lock portions together, one of said lock portions having one end extended through a hole in the wall of said outer case and formed of a hand of a lock release portion, a spring being mounted to said lock release portion to force said lock portions to respectively lock either said wheel connector bar or said control bar, said wheel connector bar having one end rotatably connected to said movable wheel-holding-plate and the other end inserted through holes in said circular intermediate wall and said outer case, after said wheel connector bar is pushed inwardly to engage said second drive assembly with said day gear train for correcting the day of the week depiction, said auto lock then automatically lock said wheel connector bar in place, said control bar being inserted through holes in said outer case and said intermediate wall, a screw mounted to said control bar, so that the body of said screw engages with said control arm portion of said control switch assembly, thus, after said control bar is pulled outwardly to lift the end of said control arm portion moving out of the bottom of the interstice of said calendar cam, said auto lock automatically locks said control bar in place for correcting the month display, a spring provided to force either said wheel connector bar or control bar moving back to original position after said auto lock is released.

* * * * *